US008261938B2

(12) United States Patent
Oradini, Sr.

(10) Patent No.: US 8,261,938 B2
(45) Date of Patent: Sep. 11, 2012

(54) FINGER COVERS AND DEVICES FOR DISPENSING FINGER COVERS

(76) Inventor: Michael E. Oradini, Sr., North Ridgeville, OH (US)

( * ) Notice: Subject to any disclaimer, the term of this patent is extended or adjusted under 35 U.S.C. 154(b) by 308 days.

(21) Appl. No.: 12/535,414

(22) Filed: Aug. 4, 2009

(65) Prior Publication Data

US 2010/0088794 A1 Apr. 15, 2010

Related U.S. Application Data

(60) Provisional application No. 61/105,147, filed on Oct. 14, 2008.

(51) Int. Cl.
*B65H 1/00* (2006.01)

(52) U.S. Cl. ..... 221/45; 221/33; 221/36; 221/51

(58) Field of Classification Search ..... 221/312 A, 221/213, 45, 51; 206/372, 499; 294/1.3, 294/25

See application file for complete search history.

(56) References Cited

U.S. PATENT DOCUMENTS

| | | | | | |
|---|---|---|---|---|---|
| 1,990,553 | A | * | 2/1935 | Hirsch et al. | 294/25 |
| 2,438,901 | A | | 4/1948 | Coxe | |
| 2,443,862 | A | | 6/1948 | Justus | |
| 2,637,031 | A | | 5/1953 | Friedman | |
| 2,701,878 | A | | 2/1955 | Davis | |
| 3,243,079 | A | * | 3/1966 | Rettmer | 221/63 |
| 3,331,626 | A | | 7/1967 | Kaufman | |
| 3,381,853 | A | * | 5/1968 | Ferris et al. | 221/63 |
| 3,407,927 | A | * | 10/1968 | Jones | 206/372 |
| 4,474,493 | A | | 10/1984 | Welch | |
| 4,510,954 | A | | 4/1985 | Miller | |
| 4,606,951 | A | | 8/1986 | Wakasugi et al. | |
| 4,763,940 | A | | 8/1988 | Held | |
| 4,938,515 | A | | 7/1990 | Fazio | |
| 4,966,174 | A | | 10/1990 | Stanczak | |

(Continued)

FOREIGN PATENT DOCUMENTS

WO 2007/117067 10/2007

OTHER PUBLICATIONS

Latex Finger Cots and Dispenser product information, first accessed at least as early as Sep. 2008.

(Continued)

*Primary Examiner* — Timothy Waggoner
(74) *Attorney, Agent, or Firm* — Calfee, Halter & Griswold LLP

(57) ABSTRACT

A finger covering system includes a finger cover dispensing device and a plurality of first and second finger covers. The finger cover dispensing device includes a dispenser body having a face and at least first and second openings disposed in the face, with the first and second openings each being sized to receive at least one finger inserted therethrough, and first and second cavities disposed in the dispenser body extending inward from the first and second openings. The plurality of first and second finger covers are disposed in the first and second cavities, with each of the plurality of first finger covers having an open first end facing the first opening of the dispenser body and a closed second end, and each of the plurality of second finger covers having an open first end facing the second opening of the dispenser body and a closed second end. The plurality of first and second finger covers are disposed in a stacked relationship within the corresponding first and second cavities.

20 Claims, 30 Drawing Sheets

U.S. PATENT DOCUMENTS

| | | | | |
|---|---|---|---|---|
| 5,337,744 | A | 8/1994 | Branigan | |
| 5,740,943 | A | 4/1998 | Shields et al. | |
| 5,761,743 | A | 6/1998 | Andrews et al. | |
| 5,980,960 | A | 11/1999 | Amitai | |
| 6,116,248 | A | 9/2000 | Walker | |
| 6,139,514 | A | 10/2000 | Benson | |
| 6,145,128 | A * | 11/2000 | Suzuki | 294/25 |
| 6,179,159 | B1 | 1/2001 | Gurley | |
| 6,182,290 | B1 | 2/2001 | Morris | |
| 6,243,868 | B1 | 6/2001 | Wanzenried | |
| 6,409,059 | B1 | 6/2002 | Calvert | |
| 6,497,340 | B2 * | 12/2002 | Grinberg | 221/45 |
| 6,578,729 | B2 | 6/2003 | Grinberg | |
| 6,662,807 | B2 | 12/2003 | Meinschewnk | |
| 6,839,905 | B1 | 1/2005 | Bruder et al. | |
| 6,868,999 | B1 | 3/2005 | Gochanour | |
| 7,251,836 | B2 | 8/2007 | Santiago | |
| 7,316,034 | B1 | 1/2008 | Berry et al. | |
| 7,380,289 | B2 | 6/2008 | Kordecki, Jr. et al. | |
| 2001/0037814 | A1 | 11/2001 | Meinschewnk | |
| 2003/0056274 | A1 | 3/2003 | Sorrels | |
| 2004/0007493 | A1 | 1/2004 | Morell et al. | |
| 2004/0031723 | A1 | 2/2004 | Jean-Louis | |
| 2004/0045071 | A1 | 3/2004 | Robins | |
| 2005/0246821 | A1 | 11/2005 | Kopp et al. | |
| 2007/0062970 | A1 | 3/2007 | Agahi et al. | |
| 2007/0262086 | A1 | 11/2007 | Cook et al. | |
| 2008/0000011 | A1 | 1/2008 | Ayala | |
| 2008/0066210 | A1 | 3/2008 | Berry et al. | |
| 2009/0013441 | A1 | 1/2009 | Duffy | |

OTHER PUBLICATIONS

Rubber Finger Pads product information, first accessed at least as early as Sep. 2008.

Tory Red Cap Finger Tips product information, first accessed at least as early as Sep. 2008.

International Search Report dated Jan. 13, 2010, for International Application Serial No. PCT/US2009/060430.

Written Opinion dated Jan. 13, 2010, for International Application Serial No. PCT/US2009/060430.

"Product: Trongs", PMQ's Pizza Magazine, Aug. 2008, p. 57.

* cited by examiner

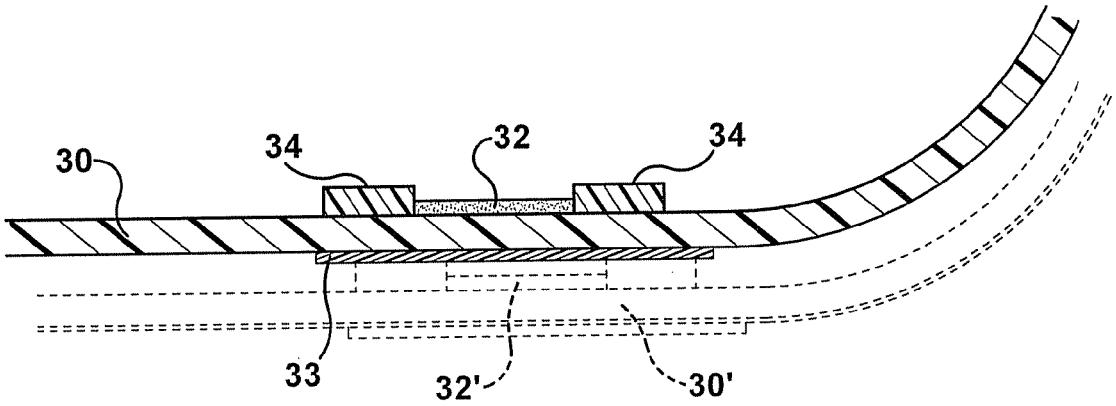
Figure 3
Figure 3A
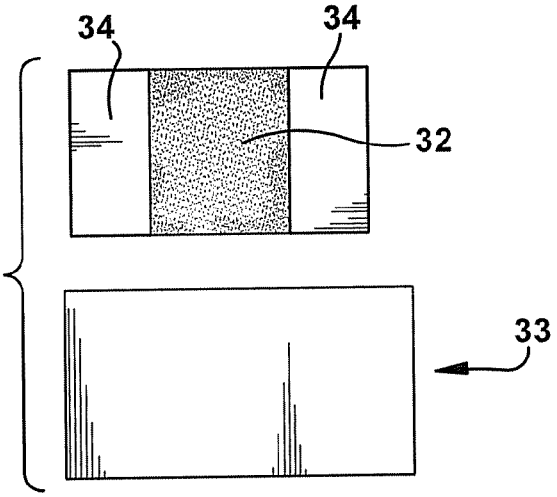

FINGER COVERS AND DEVICES FOR DISPENSING FINGER COVERS

CROSS-REFERENCE TO RELATED APPLICATION

This application claims the benefit of U.S. Provisional Patent Application Ser. No. 61/105,147, entitled FINGER COVER AND DEVICE FOR DISPENSING FINGER COVERS and filed on Oct. 14, 2008, the entire disclosure of which is hereby incorporated by reference, to the extent that it is not conflicting with the present application.

BACKGROUND

Protective or sanitary finger coverings, such as gloves or individual finger covers, may be utilized to protect a user's fingers from contaminants (e.g., grease, dirt, etc.), irritants (e.g., detergents or other chemicals), bacteria, or other substances. Such coverings may additionally or alternatively be utilized to prevent the spread of bacteria from the user's fingers to an object or material being handled by the user, such as, for example, food or sensitive electronic equipment. However, conventional plastic gloves or finger covers may be cumbersome or time consuming for the user to store, retrieve, put on, and/or take off.

SUMMARY

The present application contemplates and generally discloses inventive finger covers and inventive devices for dispensing one or more finger covers. In one embodiment, a finger cover is disclosed that forms at least a partial fluid barrier over at least a portion of a user's finger. Embodiments of the finger covers may be used in a wide variety of applications to protect the fingers of a user from becoming dirty or soiled by a foreign object. For example, an embodiment of a finger cover as disclosed in the present application is suitable to use when handling greasy or sticky food to protect the fingers from becoming soiled. The finger cover may be adapted to be placed onto a finger and may, for example, be moisture resistant or impermeable, stackable, sanitary, easily dispensable, bio-degradable and/or recyclable, and generally inexpensive.

According to another inventive aspect of the present application, a finger cover dispensing device may be provided to store one or more finger covers and maintain the finger covers in a sanitary condition prior to use. Additionally or alternatively, a finger cover dispensing device may facilitate placement of one or more finger covers on a user's fingers. In one embodiment, a finger cover dispensing device may include one or more openings for receiving one or more fingers for application of finger covers on the one or more fingers. The device may be configured to store multiple finger covers to facilitate application of finger covers to multiple fingers, and/or to facilitate re-use of the device. The inventive dispensing devices described herein may be used in a variety of locations and applications, including, for example, at a restaurant table or bar for handling greasy or sticky food, or in a public restroom for handling faucets, flush handles, or door handles.

Accordingly, in an embodiment of the present application, a finger covering system includes a finger cover dispensing device having a dispenser body with a face and an opening disposed in the face. The opening is sized to receive a finger inserted therethrough, and a cavity is disposed in the dispenser body extending inward from the opening. At least first and second finger covers are disposed in the cavity. Each of the first and second finger covers includes a tubular cover body having an open first end facing the opening of the dispenser body and a closed second end, with each tubular body being tapered inward from the first end to the second end. The first finger cover is received in the second finger cover in a stacked arrangement.

There are numerous embodiments of the methods and devices described herein, all of which are intended to be non-limiting examples. Additional features and advantages of the invention will be set forth in part in the description which follows, and in part will be obvious from the description, or may be learned by practice of the invention. The invention is far broader than the descriptions of the specific embodiments below.

BRIEF DESCRIPTION OF THE DRAWINGS

In the accompanying drawings, which are incorporated in and constitute a part of the specification, embodiments of the invention are illustrated, which, together with the detailed description given below, serve to exemplify embodiments of the invention:

FIG. 3 is a partial cross section view of a stacking arrangement of finger covers;

FIG. 3A is a plan view of adhesive and adhesive contacting portions of the stacked finger covers of FIG. 3;

DETAILED DESCRIPTION

While various aspects and concepts of the invention are described and illustrated herein as embodied in combination in the embodiments, these various aspects and concepts may be realized in many alternative embodiments, either individually or in various combinations and sub-combinations thereof. Unless expressly excluded herein all such combinations and sub-combinations are intended to be within the scope of the present invention. Still further, while various alternative embodiments as to the various aspects and features of the invention, such as alternative materials, structures, configurations, methods, devices, and so on may be described herein, such descriptions are not intended to be a complete or exhaustive list of available alternative embodiments, whether presently known or identified herein as conventional or standard or later developed. Those skilled in the art may readily adopt one or more of the aspects, concepts or features of the invention into additional embodiments within the scope of the present invention even if such embodiments are not expressly disclosed herein. Additionally, even though some features, concepts or aspects of the invention may be described herein as being a preferred arrangement or method, such description is not intended to suggest that such feature is required or necessary unless expressly so stated. Still further, representative values and ranges may be included to assist in understanding the present invention however, such values and ranges are not to be construed in a limiting sense and are intended to be critical values or ranges only if so expressly stated. The embodiments described in the summary and throughout the specification are not intended to limit the meaning or scope of the claims in any way. The terms used in the claims have all of their full ordinary meaning.

It should be noted that for the purposes of this application, the terms attach (attached), connect (connected), and link (linked) are not limited to direct attachment, connection, or linking (unless expressly identified as such), but also include indirect attachment, connection, or filing with intermediate parts, components, or assemblies being located between the two parts being attached, connected, or linked to one another. In addition, the terms attach (attached), connect (connected), and link (linked) may include two parts integrally formed or unitarily constructed. For the purposes of this application, the term finger refers not only to the index, middle, ring, small fingers, but also the thumb.

Figure 1:
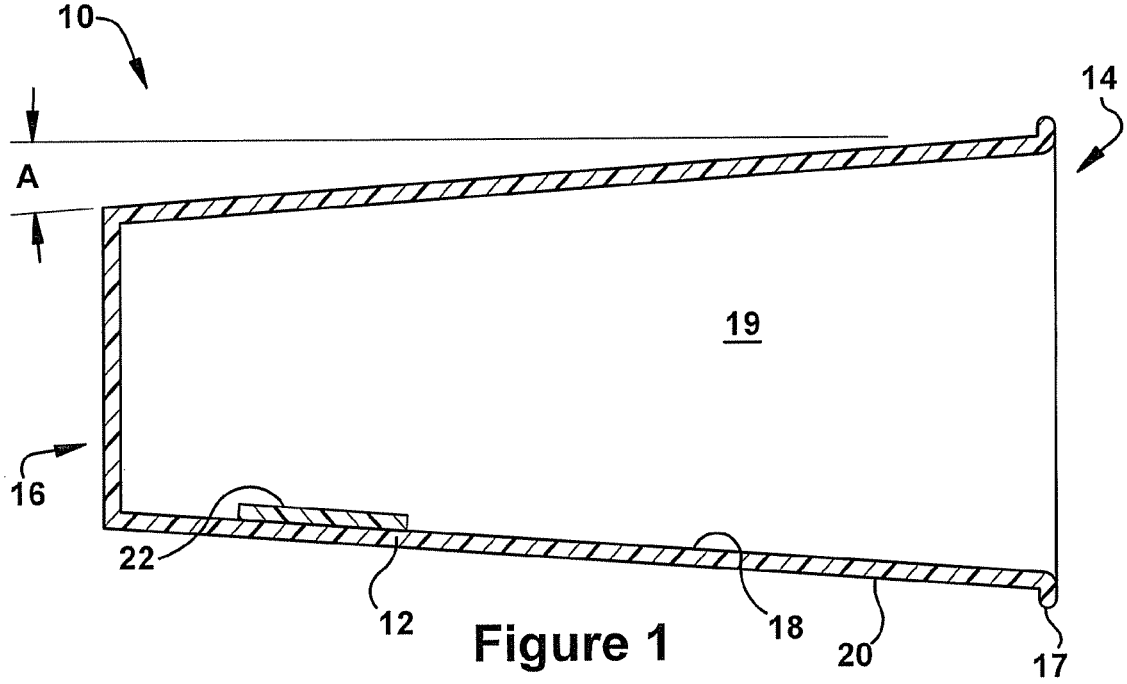
FIG. 1 is a cross section view of a finger cover.

In an inventive embodiment of a finger cover, a component or structure capable of forming at least a partial fluid barrier may be structured to cover at least a portion of at least one finger. Referring to FIG. 1, an exemplary embodiment of a finger cover 10 is illustrated. The finger cover 10 may be configured in a variety of ways, as other structures capable of forming at least a partial fluid barrier when covering a finger may be used. In the depicted embodiment, the finger cover 10 has a body 12 that forms a generally tapered, cylindrical tube having a first end 14, which is open, and a second end 16, which is closed. The cover 10 forms a chamber 19 having an inner surface 18 that is generally parallel to an outer surface 20 and a taper angle A, which allows the covers to be stacked. While any suitable taper angle may be used, in one embodiment, the taper angle A is between approximately 1 degree and approximately 15 degrees. In another embodiment, the taper angle A is between approximately 3 degrees and approximately 8 degrees.

In the depicted embodiment, the second end 16 is depicted as being generally flat. In other embodiments of the cover 10, the second end may be rounded, contoured, or both round and flat, for example, to closely fit the end of a finger. As shown in FIG. 1, the open first end 14 may include a thickened, flanged, or otherwise reinforced outer edge 17 to provide rigidity for the finger cover 10, for example, to facilitate stacking and withdrawal from a dispensing device (such as, for example, the dispensing devices described herein). While the exemplary finger covers 10 described herein include a flanged edge 17 that is substantially circular in cross-section, other flange shapes may be provided, including, for example, oval or rectangular. Additionally or alternatively, other reinforcements may be provided on the cover 10 to provide rigidity, such as, for example, ribs or bands of material. In still other embodiments, the material of the cover may be sufficiently rigid without additional reinforcement, while not restricting the flexing of knuckles when on the user's fingers.

The cover 10 may be made of any suitable material, such as, for example, materials that result in a cover being at least partially moisture resistant or impermeable, stackable, sanitary, easily dispensable, and generally inexpensive. For example, the cover 10 may be made of a laminated wax paper, vinyl, or parchment paper, and still allow for the finger to flex at the knuckles. As another example, the cover may include a flexible or stretchable material (e.g., latex or rubber) that conforms to the inserted finger to facilitate adhesion of the finger cover 10 to the inserted finger. In still other embodiments, germ and virus impervious materials, bio-degradable materials, and/or optically clear materials (e.g., for inconspicuous usage) may additionally or alternatively be utilized.

The finger cover may be made of multiple joined sheets or segments, or from a single sheet-like member. In one embodiment, shown in FIG. 2A, a tubular member 20*a* is sealed (e.g., by an adhesive or by heat sealing) at an outer end to form the cover. The member 20*a* may, but need not, include a flap portion 26*a* that may be folded over (along line 28*a*) and sealed with an upper edge 27*a* of the member 20*a* to form a flat (as opposed to a pinched) end. As shown, the tubular member may be slightly conical to facilitate stacking. In another embodiment, shown in FIG. 2B, a flat sheet 20*b* may be provided with angled side edges 25*b*, 29*b* that are joined (e.g., by an adhesive or by heat sealing) to form a conical body, and a flap 26*b* that may be folded over (along line 28*b*) and sealed with a curved upper edge 27*b* of the member 20*b* to form a flat end. A finger cover may be formed from the sheet 20*b* by wrapping the sheet around a conical or tapered rod (which may be provided with a low friction surface for easy removal) such that the edges 25*b*, 29*b* may be aligned for sealing, and the flap 26*b* folded over for sealing with the upper edge 27*b*. The bottom edge 24*b* of the sheet may be curved to provide a flat or level bottom edge when the finger cover is formed; however, other contoured edges may also be provided.

The exemplary cover 10 of FIG. 1 is adapted to fit onto a finger of a user. In an exemplary embodiment, the cover 10 is about 1.5 inches to about 2.5 inches in length and is adapted to fit onto a finger so that it covers the finger tip and at least a portion of the middle phalanx of the index, middle, ring, or small finger or the proximal phalanx of the thumb. Since the fingers on a user are different length and thickness and the fingers of two different users may differ in length and thickness, covers 10 of different length and diameter may be provided. For example, the covers 10 may be provided in small, medium, large, and extra-large sizes (regarding to length and diameter of the covers). Within each size, a different cover may be provided for the thumb, for the small finger, and for the index, middle and ring fingers. Additionally, longer covers (e.g., approximately 3 inches in length) may be provided to accommodate a user with long fingernails, and, in some embodiments, reinforced (e.g., with thicker or stronger material) closed ends may be provided to resist tearing, for example, from contact with fingernails. Furthermore, shorter covers (e.g., approximately one inch in length) may be provided, for example, for use on a public keyboard (e.g., in a public library or school), public telephone, or other applications in which only coverage of the fingertips is necessary or desired.

Figure 2A:
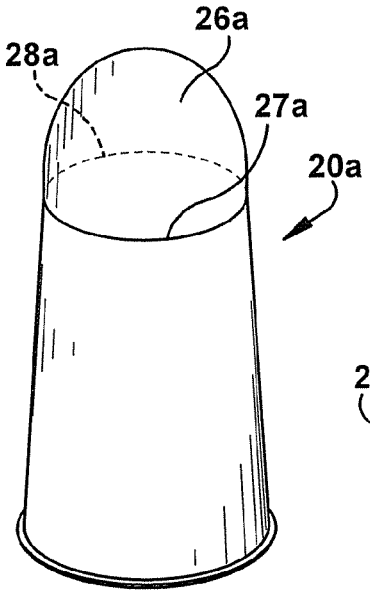
FIG. 2A is a side view of a tubular member for forming a finger cover.
Figure 2B:
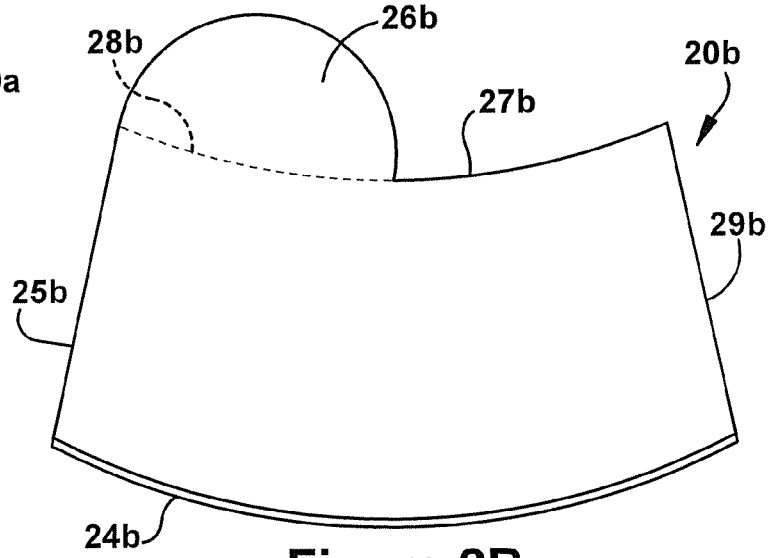
FIG. 2B is a plan view of a sheet for forming another finger cover.
Figure 2C:
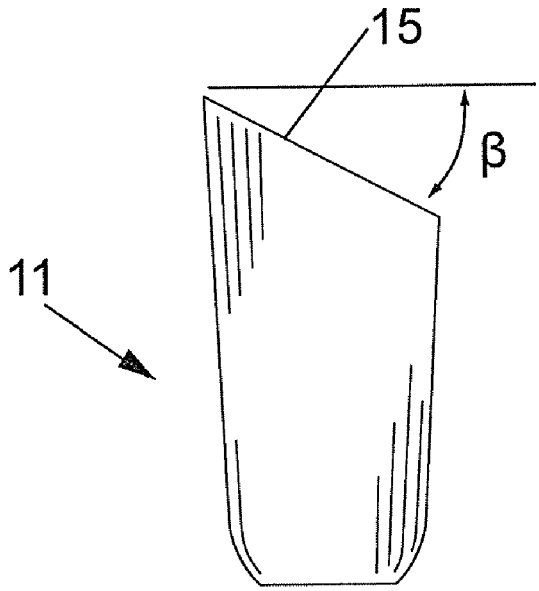
FIG. 2C is a side view of another finger cover.
Figure 2D:
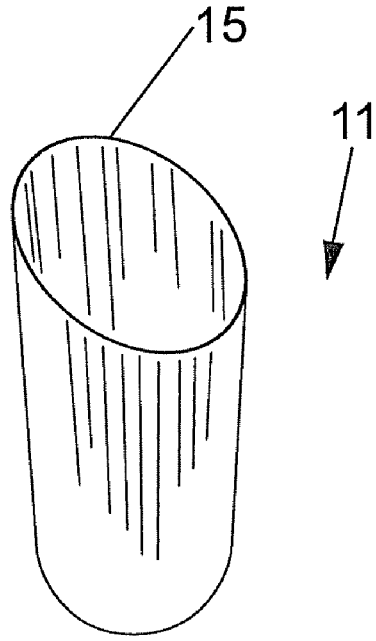
FIG. 2D is an upper perspective view of the finger cover of FIG. 2C.
Figure 2E:
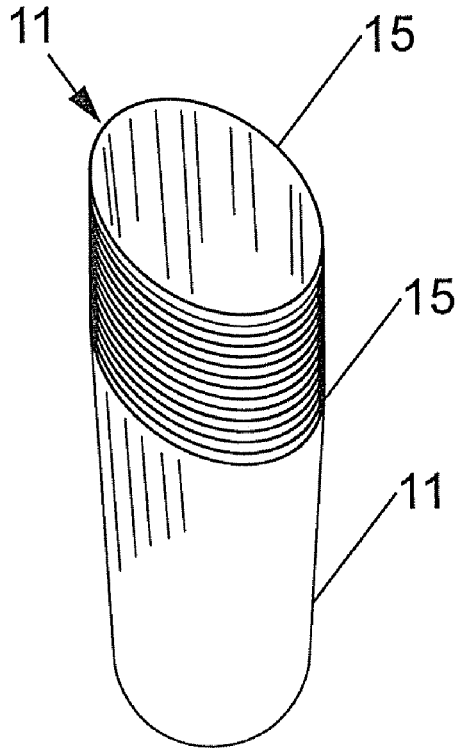
FIG. 2E is an upper perspective view of a stack of finger covers.

Further, while the cover 10 of FIGS. 1, 2A, and 2B is shown with a substantially flat or uniform first end 14, the finger cover may alternatively be provided with a non-uniform first end. For example, as shown in FIGS. 2C and 2D, a finger cover 11 may be provided with an outer edge 15 disposed at an angle β (e.g., an angle of approximately 20°), for example, to facilitate bending of the user's fingers while the finger covers 11 are worn. The angled edge 15 may also facilitate removal from a tight-fitting opening (for example, a cavity provided with a wiper, as described in greater detail below), since the entire edge 15 does not engage the opening all at once. Instead, the opening is first engaged by the raised or uppermost portion of the edge 15, thereby reducing initial friction between the finger cover 11 and the opening. The finger cover 11 of FIG. 2C may be formed from a tubular member (similar to the tubular member 20*a* of FIG. 2A), from a sheet with joined side edges (similar to the sheet 20*b* of FIG. 2B), or by any other suitable method. As shown in FIG. 2E, the finger covers 11 may, but need not, be stacked with the angled outer edges 15 aligned with each other.

The covers 10 may be configured such that when a plurality of covers are stacked (for example, in a cover holder or dispenser, an example of which is described in greater detail below), and a user places a finger within the cover and withdraws the finger, the innermost cover is apt to stay on the finger but separate from the remaining covers in the stack such that only a single cover is removed at a time. The covers 10 may be configured in a variety of ways to accomplish this. For example, the interior of the covers 10 may include a finger engaging region having a frictional or adhesive surface 22 that creates greater friction or adhesion between the surface and a user's finger than would be present between the friction or adhesive surface and the exterior surface 20 of a cover. Thus, when the multiple covers 10 are stacked, and a user places a finger into the innermost cover 10, the friction or adhesion between the surface 22 of the innermost cover and the user's finger will be greater than the friction or adhesion between the adhesive surface 22 on the inner surface of an outer adjacent cover and the exterior surface 20 of the innermost cover 10. Thus, the innermost cover will adhere to the user's finger and slide out of the outer adjacent cover, which will remain in the stack of finger covers 10, for example, in a finger cover dispensing device. Examples of an adhesive surface include a glue, adhesive coating, or adhesive patch applied to or impregnated in the inner surface of the finger cover. Examples of a frictional surface include a ribbed or abraded surface, or an abrasive composite or patch applied to or impregnated in the inner surface of the finger cover.

Many different stacking arrangements may be utilized to allow an endmost and innermost finger cover to adhere to or grip onto an inserted finger and be released from an adjacent finger cover in the stack. In one embodiment, an adhesive resistant or reduced friction (e.g., a "non-stick" food-safe coating) coating or material may be provided on the outer surfaces of the endmost and innermost finger covers, and on finger covers in between, to prevent or minimize adhesion or gripping between the endmost finger cover and the adhesive or frictional portions of the adjacent finger cover in the stack. FIG. 3 illustrates an exemplary embodiment of a finger cover 30, which may include one or more adhesive strips or patches 32 of any suitable shape, size or orientation on an inner surface of the finger cover 30, and an adhesive resistant coating 33 on an outer surface of the finger cover 30, with the adhesive resistant coating 33 being sized and positioned to partially or fully cover and contact the adhesive strip or patch 32' of the adjacent finger cover 30'. The contact between the adhesive resistant coating 33 and the adjacent adhesive strip 32' facilitates separation of the finger cover 30 from the adjacent finger cover 30' when the user withdraws his or her inserted finger from the stacked finger covers. The adhesive resistant coating may be applied to the entire outer surface of the finger cover 30, or the coating may be limited to the region that contacts the adhesive patch 32' of the adjacent finger cover 30' (or any other suitable amount of coverage).

Additionally or alternatively, adhesive resistant (or reduced friction) zones 34 (which may be provided in any suitable shape, size, or orientation), may be provided on the inner surface of the finger cover 30 proximate to the adhesive strip 32 and adjacent to the adhesive resistant coating 33. This may facilitate separation of the finger cover 30 from the adjacent finger cover 30', despite some amount of adhesion between the stacked finger covers 30, 30'. The adhesive resistant zones 34 may form strips, spots, or any other suitable shape or arrangement. One such embodiment includes adjacent adhesive and non-stick strips, as utilized for example, in sortable POST-IT® index cards manufactured by 3M.

Figure 4:
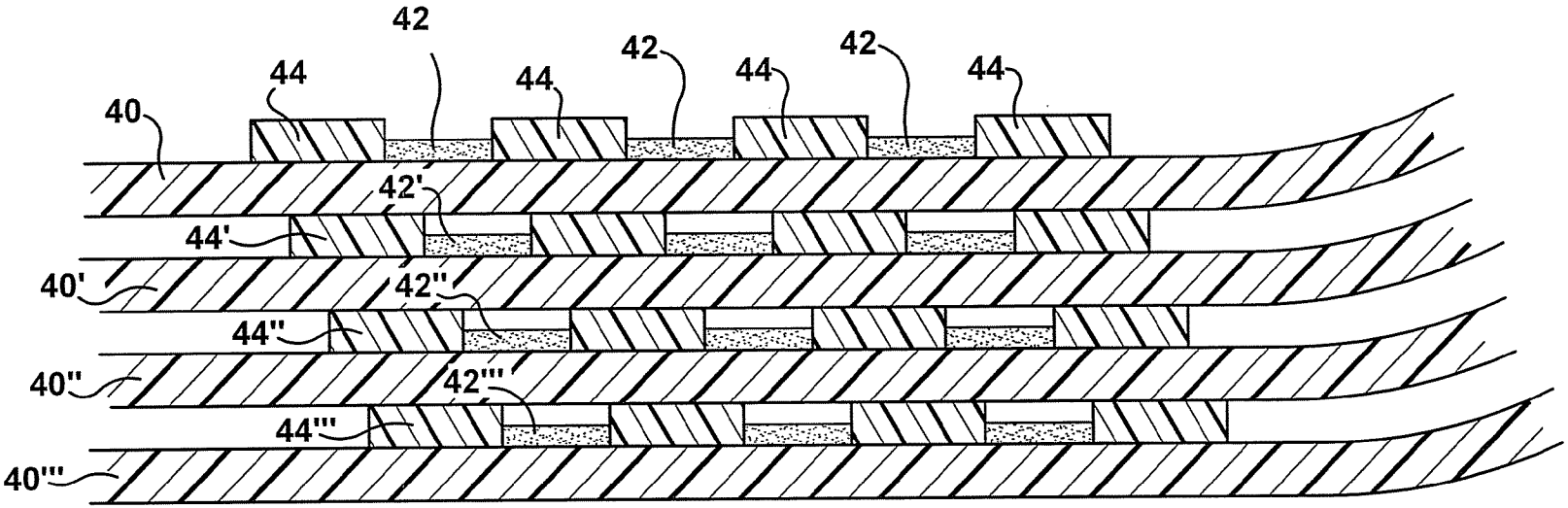
FIG. 4 is a cross section view of another stacking arrangement of finger covers.
Figure 4A:
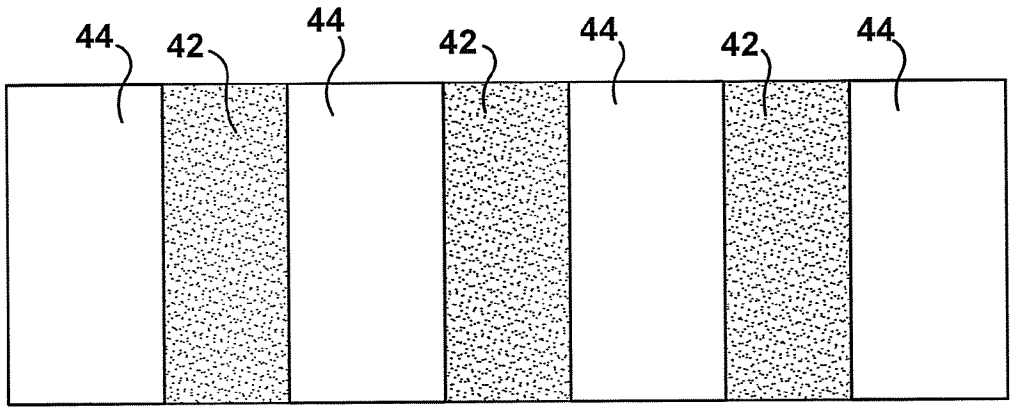
FIG. 4A is a plan view of an adhesive portion of the stacked finger covers of FIG. 4.
Figure 5:
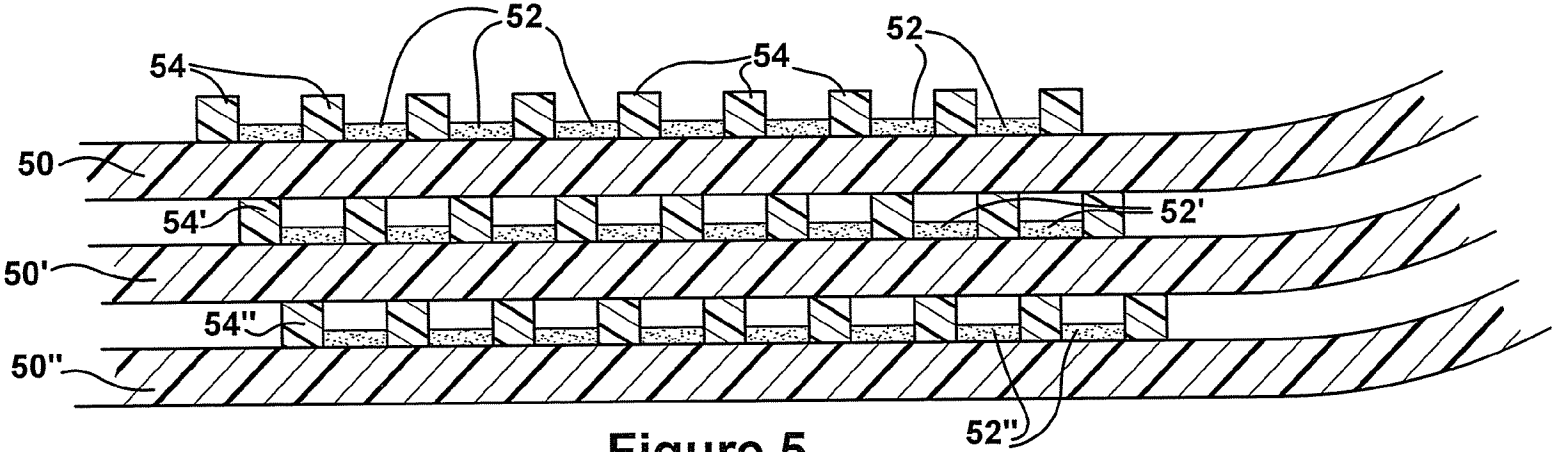
FIG. 5 is a cross section view of still another stacking arrangement of finger covers.
Figure 5A:
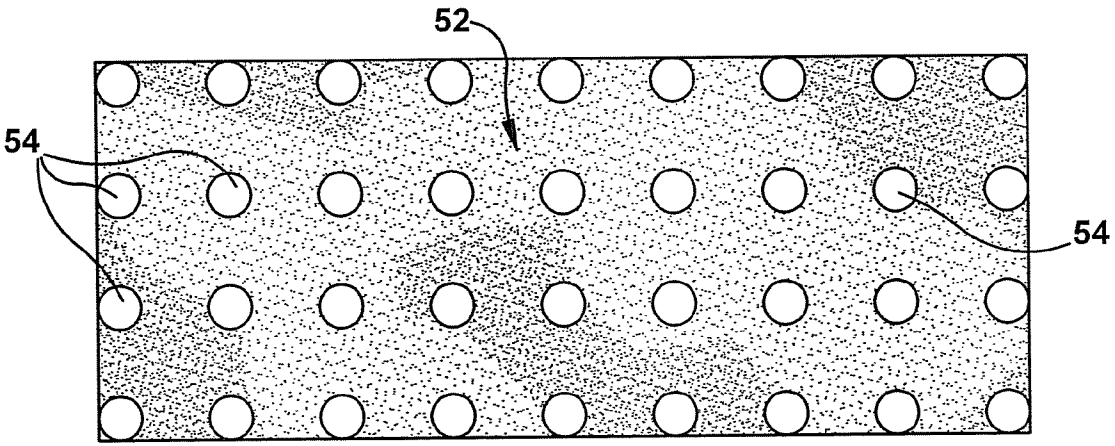
FIG. 5A is a plan view of an adhesive portion of the stacked finger covers of FIG. 5.

In another embodiment, an inner surface of a finger cover may include raised non-adhesive (or reduced friction) surfaces that prevent or reduce adhesion or gripping between the finger cover and an inwardly adjacent stacked finger cover. FIG. 4 illustrates an exemplary embodiment of a finger cover 40 having adhesive coated portions 42 separated by raised non-adhesive portions 44. While the contoured surface of a user's fingertip allows for sufficient contact between the fingertip and the adhesive portions 42, the raised non-adhesive portions of the adjacent finger cover 40' prevent or minimize contact (and adhesion) between the finger cover's outer surface and the adhesive portions 42' of the adjacent finger cover 40'. The non-adhesive portions 44, 44', 44", 44'" and/or the portions of the outer surfaces of the finger covers 40, 40', 40", 40'" that may come in contact with adhesive portions 42, 42', 42", 42'", may, but need not, be provided with an adhesion resistant coating. While the illustrated embodiment includes alternating rectangular strips of adhesive and non-adhesive portions 42, 44 (see FIG. 4A), in other embodiments, other shapes, sizes, patterns and orientations of adhesive and non-adhesive portions may be used. For example, as shown in FIGS. 5 and 5A, a finger cover 50 may be provided with a pattern of raised non-adhesive dots 54 raised or extending outward from an adhesive portion 52 on the inner surface of the finger cover 50. Adhesive resistant coatings, may, but need not, be applied as shown and described for the embodiment of FIG. 4.

Figure 6A:
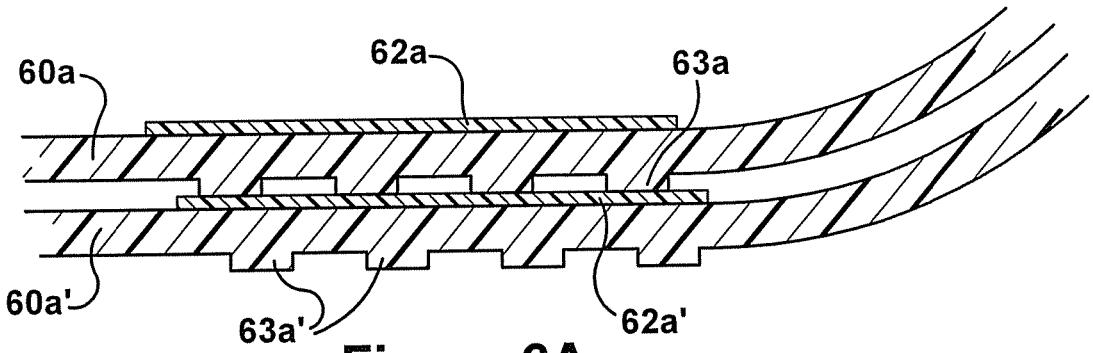
FIGS. 6A, 6B, and 6C are cross section views of additional stacking arrangements of finger covers.
Figure 6B:
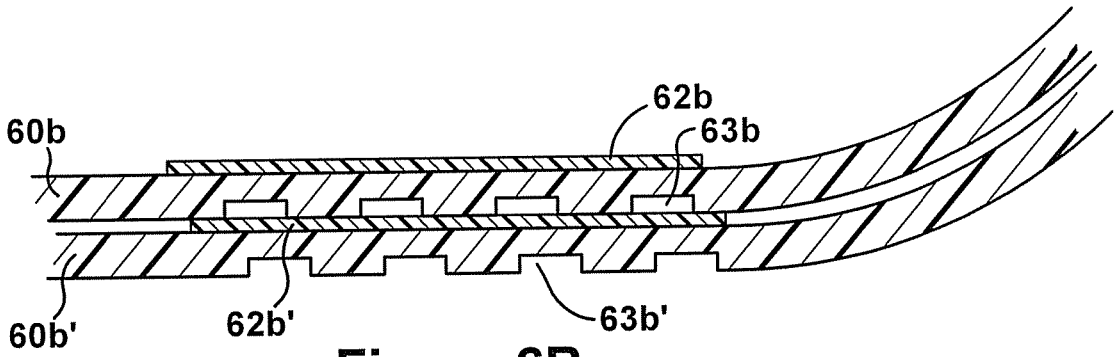
Figure 6C:
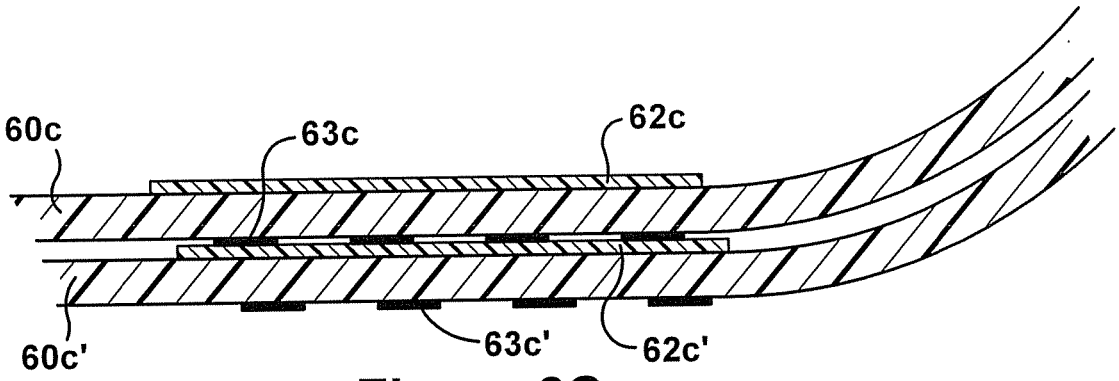

In still another embodiment, an outer surface of a finger cover may be provided with an outer surface having a raised, pressed (e.g., embossed), or adhesive resistant coated pattern, which reduces adhesion between adjacent finger covers enough to allow for separation of the finger covers. In the example of FIG. 6A, a raised pattern 63*a* is provided on an outer surface of the finger cover 60*a* to reduce adhesive contact between the finger cover 60*a* and the adhesive portion 62*a'* of the adjacent finger cover 60*a'*. In the example of FIG. 6B, a pressed or embossed pattern 63*b* is provided on an outer surface of the finger cover 60*b* to reduce adhesive contact between the finger cover 60*b* and the adhesive portion 62*b'* of the adjacent finger cover 60*b'*. In the example of FIG. 6C, an adhesive resistant pattern 63*c* is provided on an outer surface of the finger cover 60*c* to reduce adhesive contact between the finger cover 60*c* and the adhesive portion 62*c'* of the adjacent finger cover 60*c'*. Any suitable pattern may be utilized for the outer surface of the finger cover 60*a*, 60*b*, 60*c*, including, for example, diamond shaped, dimpled, swirled, herringbone, saw tooth, or brick patterns.

In yet another embodiment, a finger cover may be formed to have a first raised pattern on an outer surface, and a second raised pattern on an inner surface, such that when two of the finger covers are in a stacked arrangement, the first raised pattern on the first finger cover engages the second raised pattern on the second finger cover primarily only where the first and second raised patterns intersect or coincide. This results in reduced surface contact between the first and second finger covers, which may facilitate separation of the first and second finger covers when a finger is inserted into the first finger cover and withdrawn from the stack. Greater surface contact between a relatively smooth (as compared to the patterned outer surface of the finger cover) finger and the second raised pattern on the inner surface of the finger cover may facilitate greater adhesion between the finger and the finger cover. The raised patterns may be formed, for example, by embossing, molding, or any other suitable method.

Figures 6D, 6E:
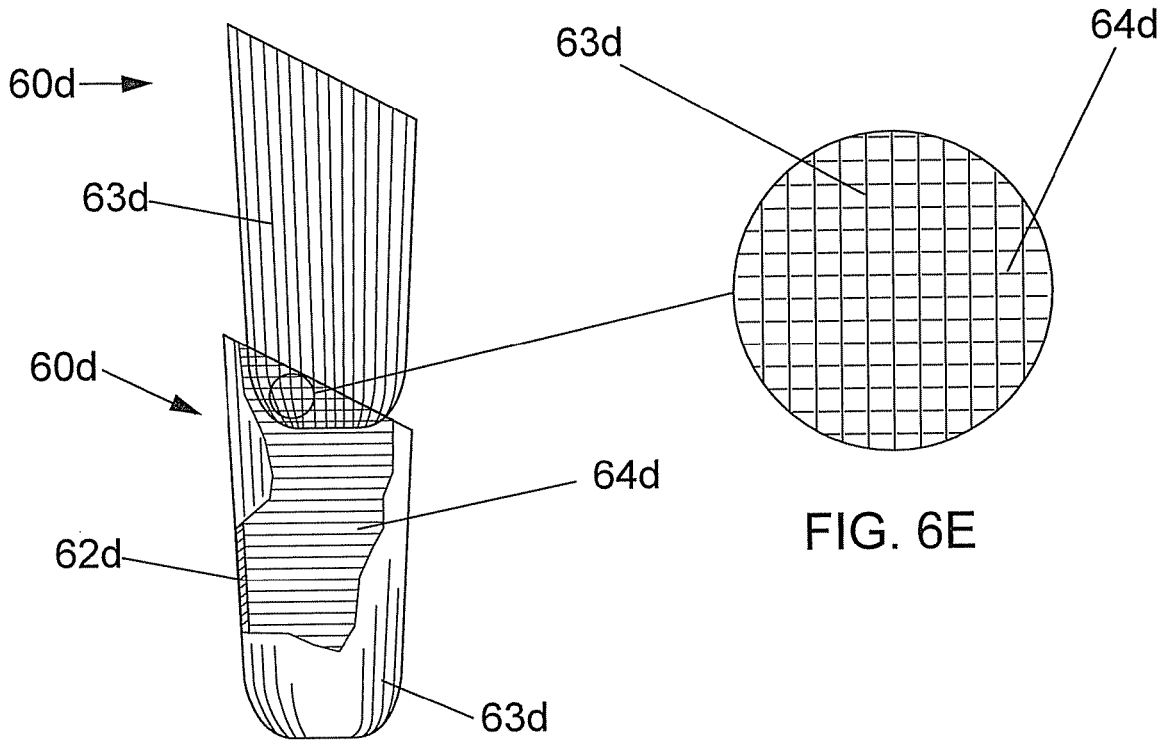
FIG. 6D is a side view of another stacking arrangement of finger covers, with a portion cut away to illustrate features on the internal surface of the finger cover.
FIG. 6E is an enlarged partial schematic view of an overlapping arrangement of a first raised pattern on an outer surface of the first finger cover of FIG. 6D and a second raised pattern on an inner surface of the adjacent stacked second finger cover of FIG. 6D.
Figure 6F:
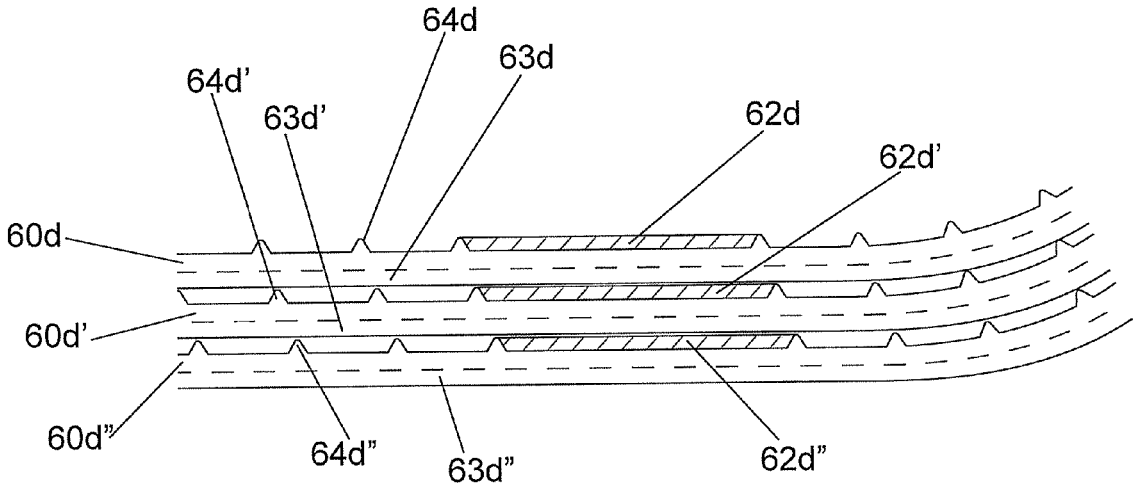
FIG. 6F is a partial side cross section view of first, second, and third finger covers, consistent with the finger covers of FIG. 6D.

FIG. 6D illustrates an exemplary embodiment of a finger cover 60*d* having a first raised pattern 63*d* on an outer surface and a second raised pattern 64*d* on an inner surface. In the illustrated example, the first raised pattern 63*d* includes vertical or axial lines (which may be uniformly or randomly spaced), and the second raised pattern 64*d* includes horizontal or lateral lines (which may be uniformly or randomly spaced). When a first finger cover 60*d* is stacked within a second finger cover 60*d*, the first raised pattern 63*d* of the first finger cover engages the second raised pattern 64*d* of the second finger cover primarily only where the first and second raised patterns 63*d*, 64*d* intersect, as shown in FIG. 6E, thereby reducing surface contact between the first and second finger covers 60*d* and facilitating separation. During separation of the first and second finger covers 60*d*, 60*d'*, the raised vertical lines 63*d* on the outer surface of the first finger cover 60*d* slide on the raised horizontal lines 64*d'* on the inner surface of the second finger cover 60*d'* for reduced friction or adhesion between the finger covers 60*d*, 60*d'* (see FIG. 6F). As shown, the finger cover 60*d* may, but need not, also include one or more adhesive or frictional patches or strips 62*d* (as described in previous embodiments) on the inner surface of the finger cover 60*d* to facilitate adhesion of the finger cover to the user's finger. The raised horizontal lines 64*d*, 64*d'*, 64*d"* may further minimize contact between the adhesive strips 62*d'*, 62*d"* and the adjacent vertical lines 63*d*, 63*d'* (FIG. 6F). An adhesive resistant coating can be applied to an outer surface of the finger covers 60*d*, 60*d'*, 60*d"*, consistent with previous embodiments.

In another embodiment, the first (outer) raised pattern may include horizontal lines and the second (inner) raised pattern may include vertical lines. Still other raised patterns may be utilized, including, for example, lines of varying angles and spacing, concentric or overlapping rings, random dimpling, or other such suitable patterns. These raised patterns may be provided, for example, by embossing a laminated wax paper or other biodegradable paper. In one such example, the second (inner) raised pattern may be embossed first, and the first (outer) raised pattern may be embossed second, such that the outer pattern may present a continuous or uninterrupted embossed pattern.

In all adhesive arrangements, the adhesive may be configured to adhere to the fingers sufficiently to remain attached during use, while still allowing for easy and rapid removal after use.

Alternatively, an abrasive strip or patch can be used in lieu of an adhesive patch, which may eliminate the need for adhesion resistant coatings. This abrasive strip or patch can be used in all stacking arrangements, for example, to provide sufficient friction with the finger when removing a cover from the dispenser.

Finger covers may be kept in a sanitary condition and protected in a dispenser prior to use. In an inventive embodiment of a dispensing device applying at least some of the principles of the present application, a device is provided that stores multiple finger covers in a manner in which a user may place finger covers on a plurality of fingers simultaneously or nearly simultaneously. In one embodiment, the device includes a plurality of open-ended cavities in which finger covers are stored. A user, by simply inserting a finger into a cavity and withdrawing the finger, places a single finger cover onto the finger.

Figure 7:
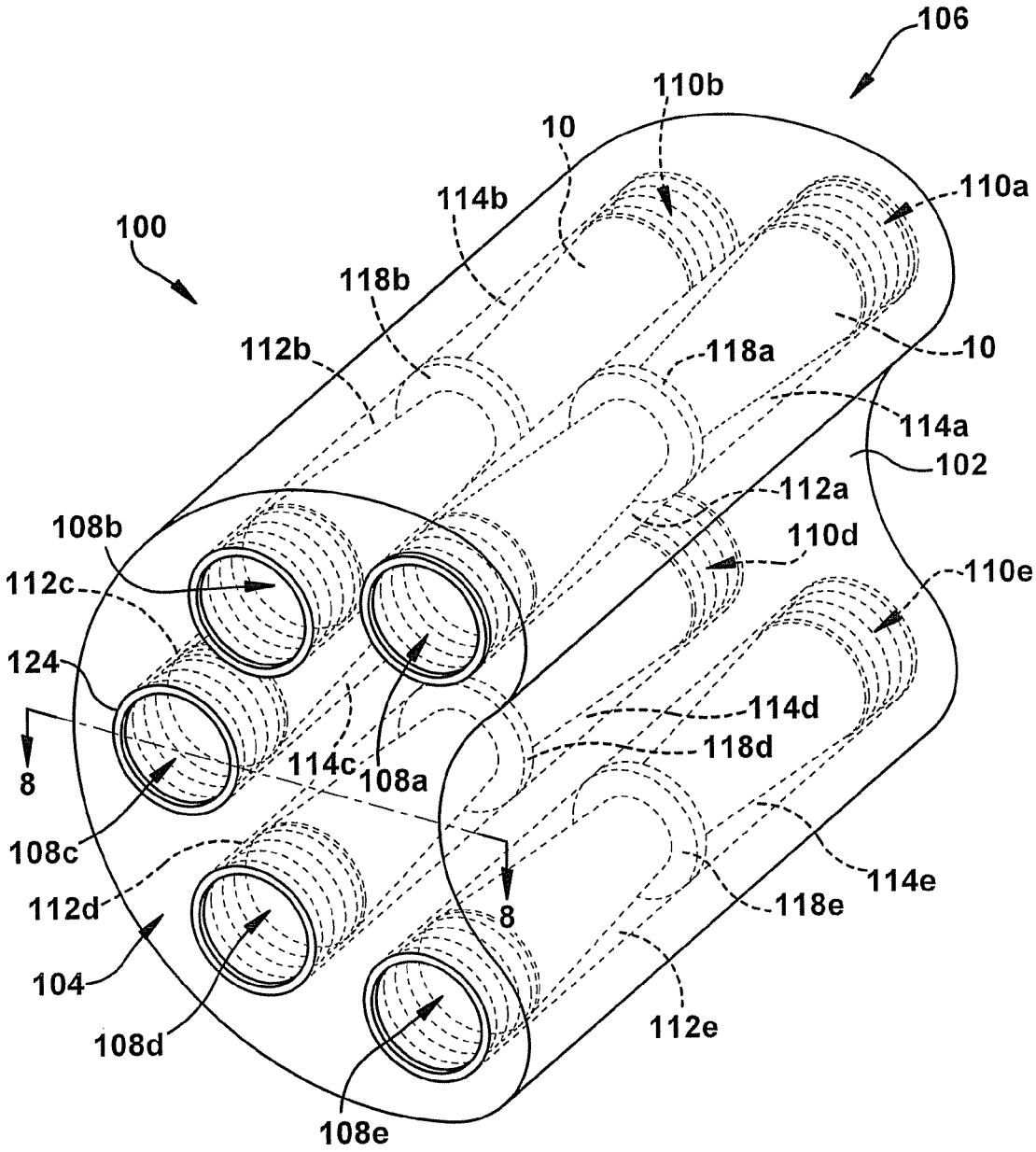
FIG. 7 is a perspective view of a device for dispensing finger covers.
Figure 8:
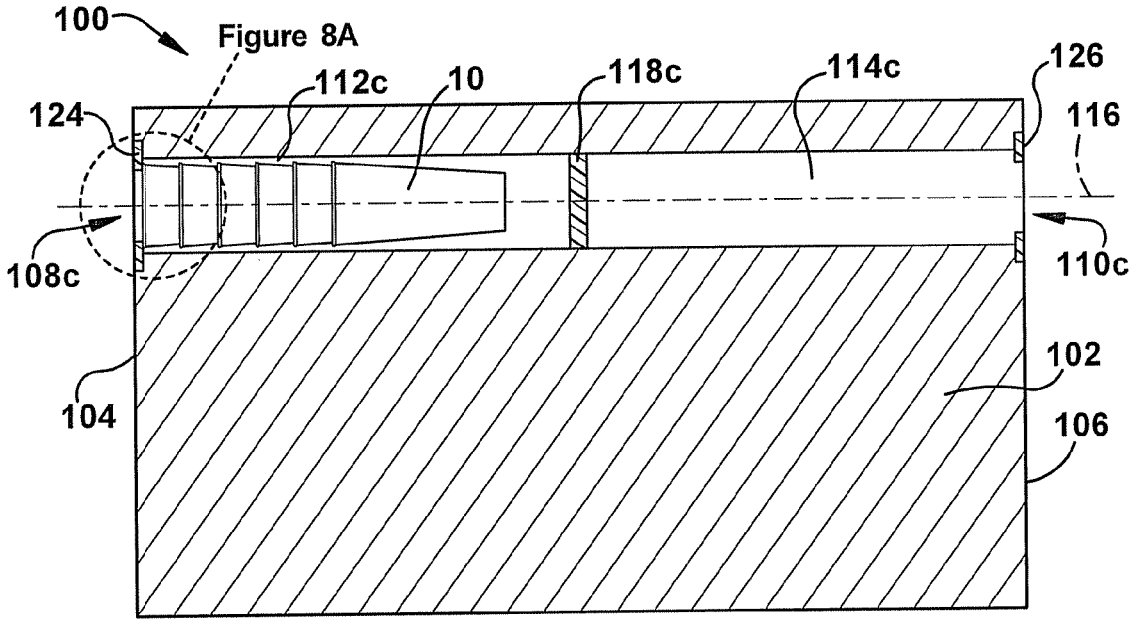
FIG. 8 is a cross section view of the device of FIG. 7.

FIGS. 7 and 8 illustrate an exemplary embodiment of a device for dispensing one or more finger covers, such as, for example, the finger covers described above. The device 100 comprises a body 102 having one or more cavities or bores adapted to house finger covers 10. The body 102 may be configured in a variety of ways. Any structure capable of housing one or more finger covers in an orientation in which a finger cover is received onto a finger of a user when the user inserts the finger into the structure may be used.

In the depicted embodiment, the body 102 has a first generally flat, kidney shaped face 104 and a second generally flat kidney shaped face 106 arranged generally parallel to the first face. The first face 104 includes five openings 108*a-e*, each adapted to receive a finger from the left hand of a user. In particular, the opening 108*a* is adapted to receive the thumb, the opening 108*b* is adapted to receive the index finger, the opening 108*c* is adapted to receive the middle finger, the opening 108*d* is adapted to receive the ring finger, and the opening 108*e* is adapted to receive the small finger. The spacing of the openings 108*a-e* on the first face 104 is configured similar to the spacing of the fingers on a person's left hand if the person's hand is partially opened with all fingers generally pointing in the same direction.

As discussed above, the covers 10 may be configured or sized differently depending on which finger the specific cover is designed to cover. Similarly, the size of the openings 108*a-e* may differ to accommodate the different sized covers. For example, the small finger opening 108*e* may have a smaller diameter than index finger opening 108*b*. This, however, is not required.

The second face 106 also includes five openings 110*a-e*, each adapted to receive a finger from the right hand of a user. In particular, the opening 110*a* is adapted to receive the thumb, the opening 110*b* is adapted to receive the index finger, the opening 110*c* is adapted to receive the middle finger, the opening 110*d* is adapted to receive the ring finger, and the opening 110*e* is adapted to receive the small finger. Similar to the first face 104, the spacing of the openings 110*a-e* on the second face 106 is configured similar to the spacing of the fingers on a person's right hand if the person's hand is partially opened with all fingers generally pointing in the same direction.

Each of the openings 108*a-e*, 110*a-e* are associated with a corresponding cavity 112*a-e*, 114*a-e* defined by the body 102. In the depicted embodiment, therefore, the openings 108*a-e*, 110*a-e* provides access to the corresponding cavities 112*a-e*, 114*a-e* (e.g. the opening 108*e* provides access to the cavity 112*e*, the opening 108*d* provides access to cavity 112*d* and so on.) FIG. 8 illustrates a cross section view of the device 100 along the 8-8 plane of FIG. 7. Since the cavities 112*c* and 114*c* are similar in configuration to the other cavities, only cavities 112*c* and 114*c* will be described with the understanding that the description applies equally to all of the cavities.

Cavity 112*c* is generally cylindrical extending along a longitudinal axis 116 having a first end defined by the opening 108*c*. Cavity 114*c* is also generally cylindrical extending along the longitudinal axis 116 having a first end defined by opening 110*c*. In the depicted embodiment, the cavity 112*c* and the cavity 114*c* are substantially coaxial and connected such that the cavities form a generally straight passage through the entire body 102 from the first face 104 to the second face 106. In other embodiments, however, each cavity may not be coaxial with another cavity and/or may have a terminal end located within the body. The cavities 112*c*, 114*c* may, but need not, be provided with a frictionless or non-stick internal surface (e.g., using a non-stick coating or a reduced friction material) to prevent finger covers 10 from undesirably sticking in the cavities.

In other embodiments, the body 102 may be configured in other ways. For example, the first face 104 and second face 106 need not be parallel, flat, or kidney shaped. Other shapes and orientations are possible (including, for example, spherical, elliptical, rectangular, or curved bodies). Likewise, the cavities 108*a-e*, 110*a-e* need not be aligned or parallel with each other. Furthermore, the faces 104, 106 may include more or less than five openings. For example, in one embodiment, a face may include three holes. Still further, the faces need not be flat. A single face may be curved or may comprise one or more flat surfaces in which holes are located. In other embodiments, only one face (with openings to cavities) may be provided, and may, but need not, be mounted to a wall, table, or counter surface.

Figure 8A:
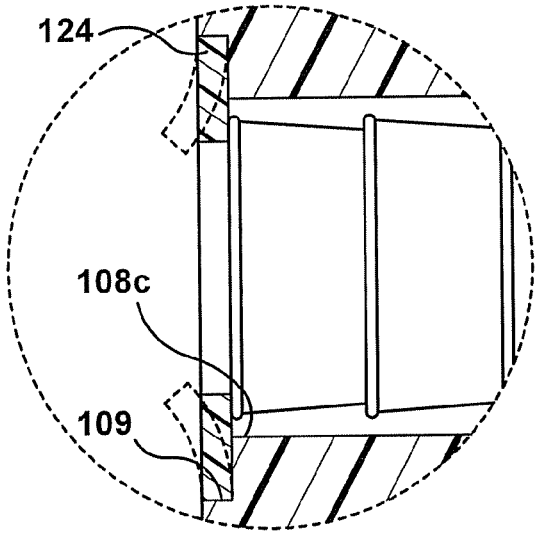
FIG. 8A is an enlarged portion of the cross section view of FIG. 8.
Figure 8B:
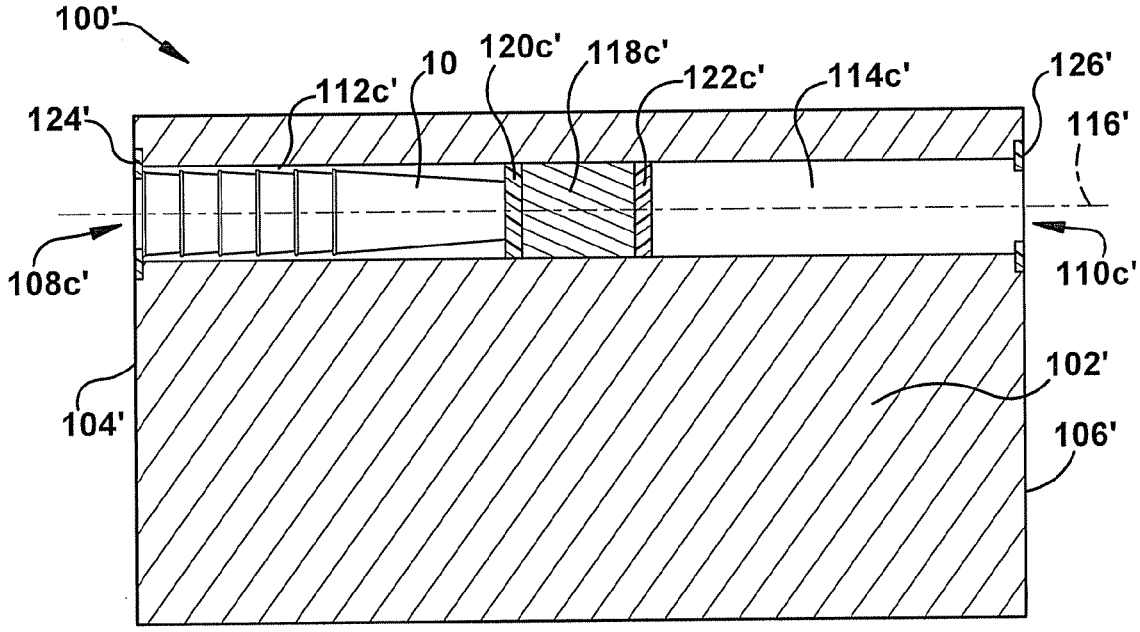
FIG. 8B is a cross section view of another device for dispensing finger covers.

As shown in FIG. 8, the aligned cavities 112*c*, 114*c* may be separated by an axially fixed single rigid spacer or divider 118*c*, which may be integral with or separable from the body 102. According to another inventive aspect of the present application, a finger cover dispensing device may be provided with one or more biasing members configured to bias the stored stacks of finger covers towards outer openings in the device, to facilitate engagement with an inserted finger. Referring to FIG. 8B, a biasing element 118*c*', such as a spring, memory foam, or other suitable biasing element is disposed generally in the middle of the passage between the cavity 112*c*' and the cavity 114*c*'. The biasing element 118*c*' may be fixed axially in place (e.g., with an adhesive or by an interference fit or press fit engagement) such that axial movement of the entire biasing element is prevented while still allowing the element to compress and return to its free state.

In the embodiment of FIG. 8B, a first spacer 120*c*' is positioned adjacent the biasing element 118*c*' on the side of the cavity 112*c*' and a second spacer 122*c*' is disposed adjacent the biasing element 118*c*' on the side of the cavity 114*c*'. In the depicted embodiment, the spacers 120*c*', 122*c*' are discs made of any suitable material, such as plastic for example. In another embodiment, no spacer is used and the covers 10 directly engage the biasing element. In an embodiment of the device in which the cavities have a terminal end, a separate biasing element may be positioned at the terminal end of each cavity. The biasing element may facilitate installing the cover on a finger and affixing the adhesive on the finger while being compressed, as well as assisting in the removal of the cover from the dispenser while extending or returning to the biasing element's free state.

The device 100 may also includes structure for retaining the covers within the device. The structure may be configured in a variety of ways. Any structure that will allow a cover to be removed from the device when the cover is positioned onto a finger of the user while preventing the cover from inadvertently falling out of the device (e.g., due to gravity) may be used. In one such embodiment, a membrane or other flexible or releasable retaining structure may be provided as a wiper at the opening of each cavity. Referring to FIG. 8, a first membrane 124 is positioned at opening 108*c* and a second membrane 126 is positioned at opening 110*c*. Each membrane 124, 126 is generally annular, flexible, and adapted to retain the stacks of finger covers 10 within the cavities 112*a-e*, 114*a-e*, while allowing the inserted finger and adhered finger cover 10 to be withdrawn from the cavity. The flexible membranes 124, 126 may also allow new finger covers 10 to be installed in the cavities 112*a-e*, 114*a-e* (e.g., by flexing inward to allow the finger covers 10 to be pushed past the membrane). The membranes 124, 126 may be made of any suitable material, such as, but not limited to, latex, rubber, and fiber. As shown in the enlarged view of FIG. 8A, the membranes 124, 126 may be secured around the outer edges within corresponding counterbores 109 of the openings 108*a-e*, 110*a-e*, and the inner edges of the membranes 124, 126 extend inward of the openings 108*a-e*, 110*a-e* and are permitted to flex to allow for storage and removal of the finger covers 10. Other types of flexible wipers may be utilized, including, for example, fibers, flaps, or tabs.

In operation of the illustrated device 100, finger covers 10 are stacked and pushed into each opening 108*a-e*, 110*a-e* corresponding to the appropriate cover 10 and finger. In an exemplary embodiment, about fifty (50) finger covers 10 may be inserted in a stacked arrangement in each cavity 112*a-e*, 114*a-e*. In other embodiments, the cavities may be configured to store more or less than fifty covers. With the device 100 supported externally, for example on a surface or by the hands of a user, the user may insert his or her fingers into the appropriate opening on the first face 104 and the second face 106. As the user's fingers are inserted into the cavities 112*a-e*, 114*a-e*, the fingers are received in the endmost finger covers 10 for automatic application of the finger covers on the fingers. When the user removes his/her fingers, a single finger cover 10 per finger is withdrawn from the device, already in place on the user's finger. Thus, the device 100 may be used to place finger covers 10 on all the fingers of a user simultaneously. The user, of course, may opt to only insert select fingers into the device in order to place finger covers on less than all of the user's fingers.

FIGS. 9A-9G illustrate another exemplary finger cover dispensing device 200 similar to the device 100 described above, but including additional inventive features. As with the device 100 of FIGS. 7 and 8, the illustrated dispensing device 200 includes a body 202 having cavities 212*a-e* extending from openings 208*a-e* in an upper face 204 of the body 202 to retain stacks of finger covers (e.g., any one or more of the inventive finger covers described above). The openings 208*a-e* and cavities 212*a-e* may, but need not be, consistent with the openings and cavities of the device 100 of FIGS. 7 and 8, and may include one or more of the corresponding features described above. The openings 208*a-e* of the device 200 may be positioned to facilitate use with either a right hand or left hand.

Figure 9A:
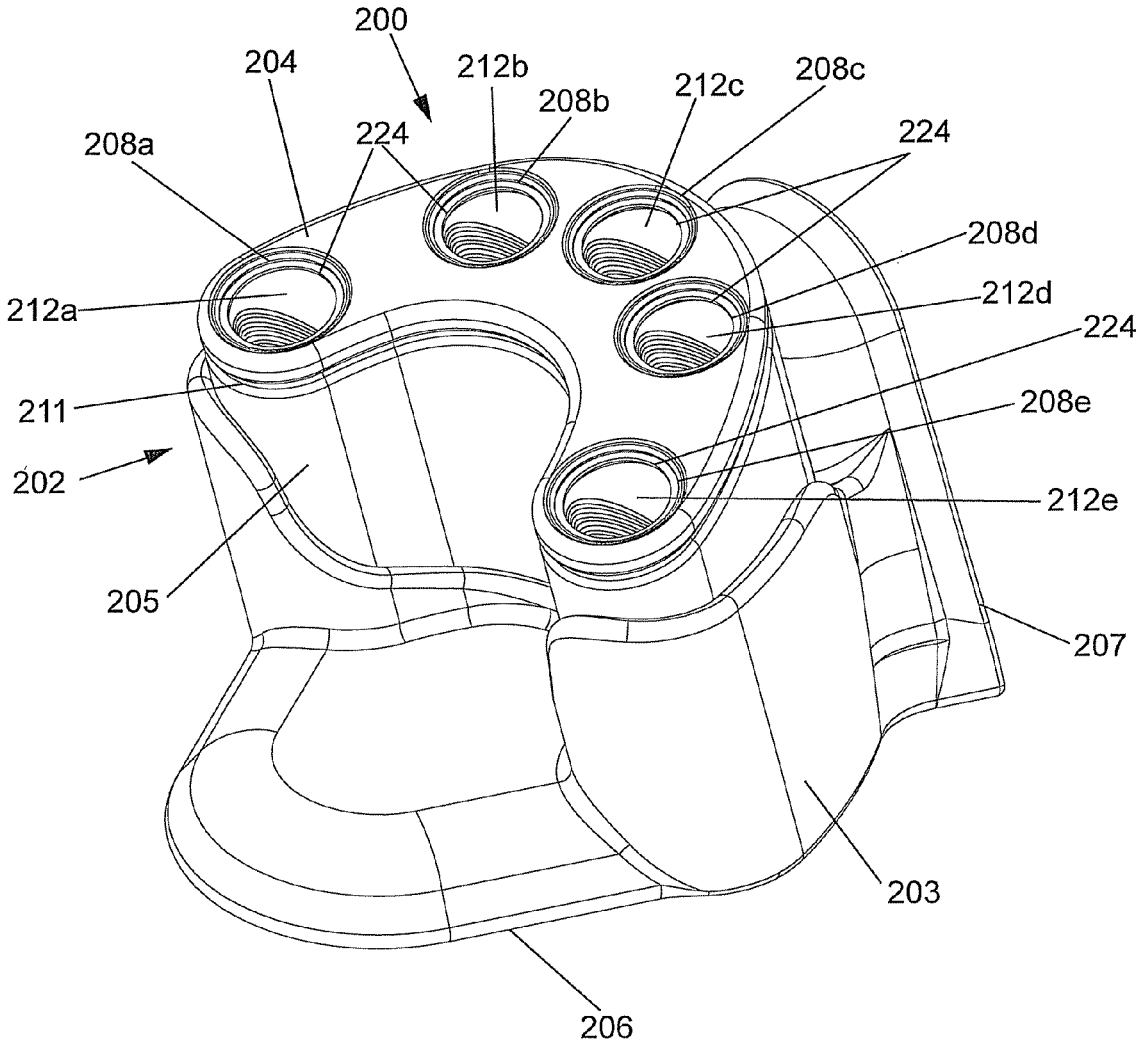
FIG. 9A is an upper front perspective view of a device for dispensing finger covers.
Figure 9B:
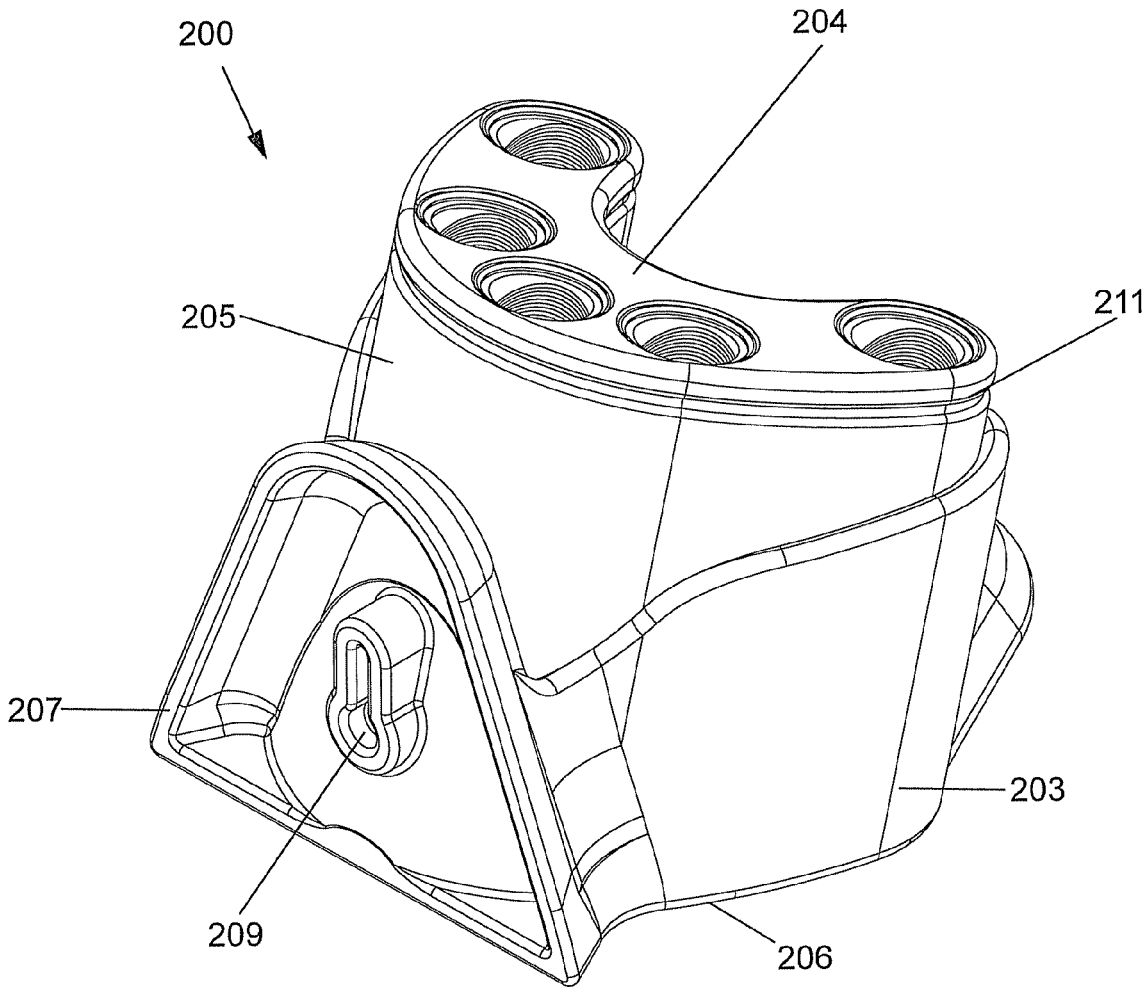
FIG. 9B is a rear perspective view of the device of FIG. 9A.
Figure 9C:
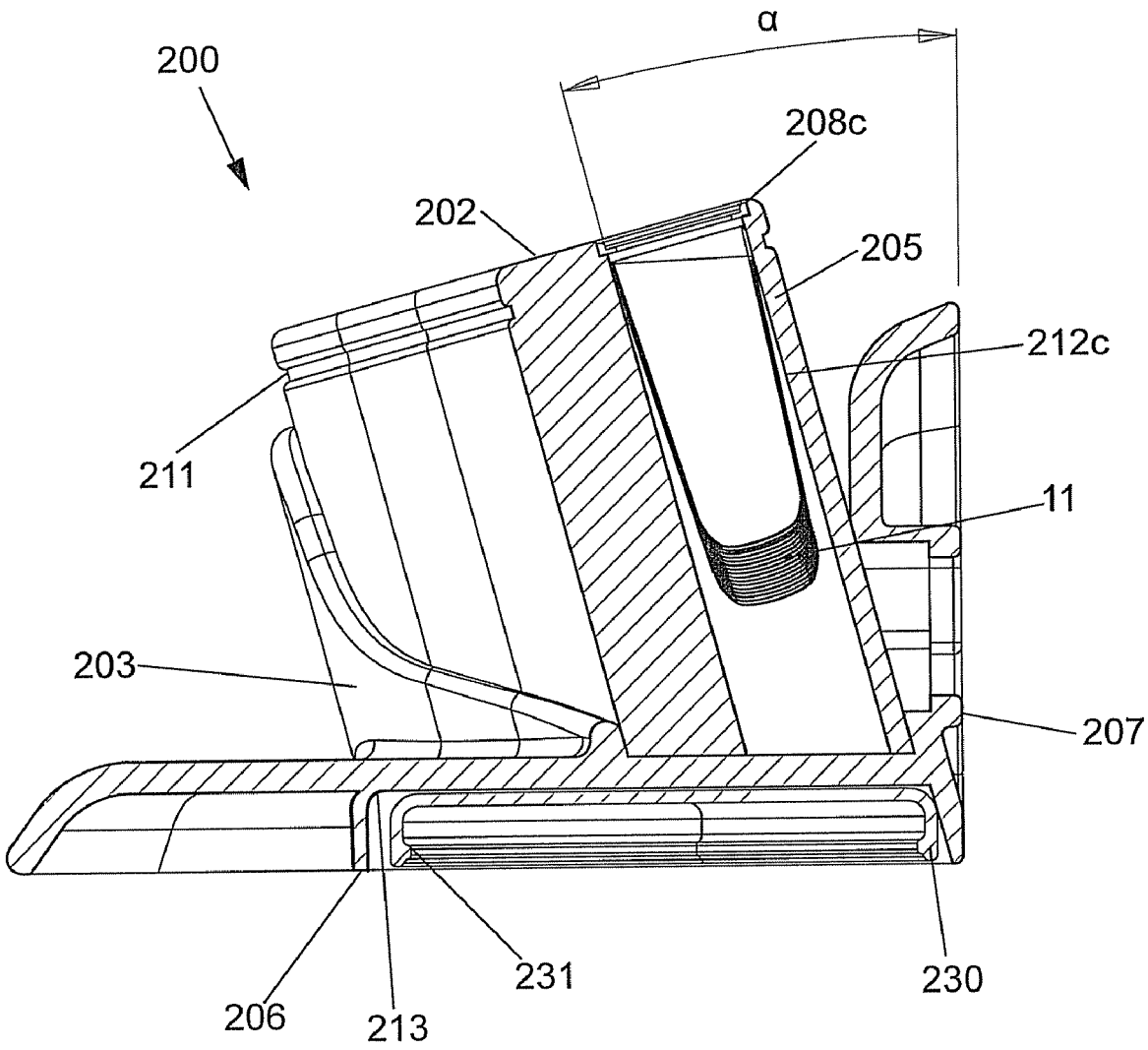
FIG. 9C is a side cross-sectional view of the device of FIG. 9A.
Figure 9D:
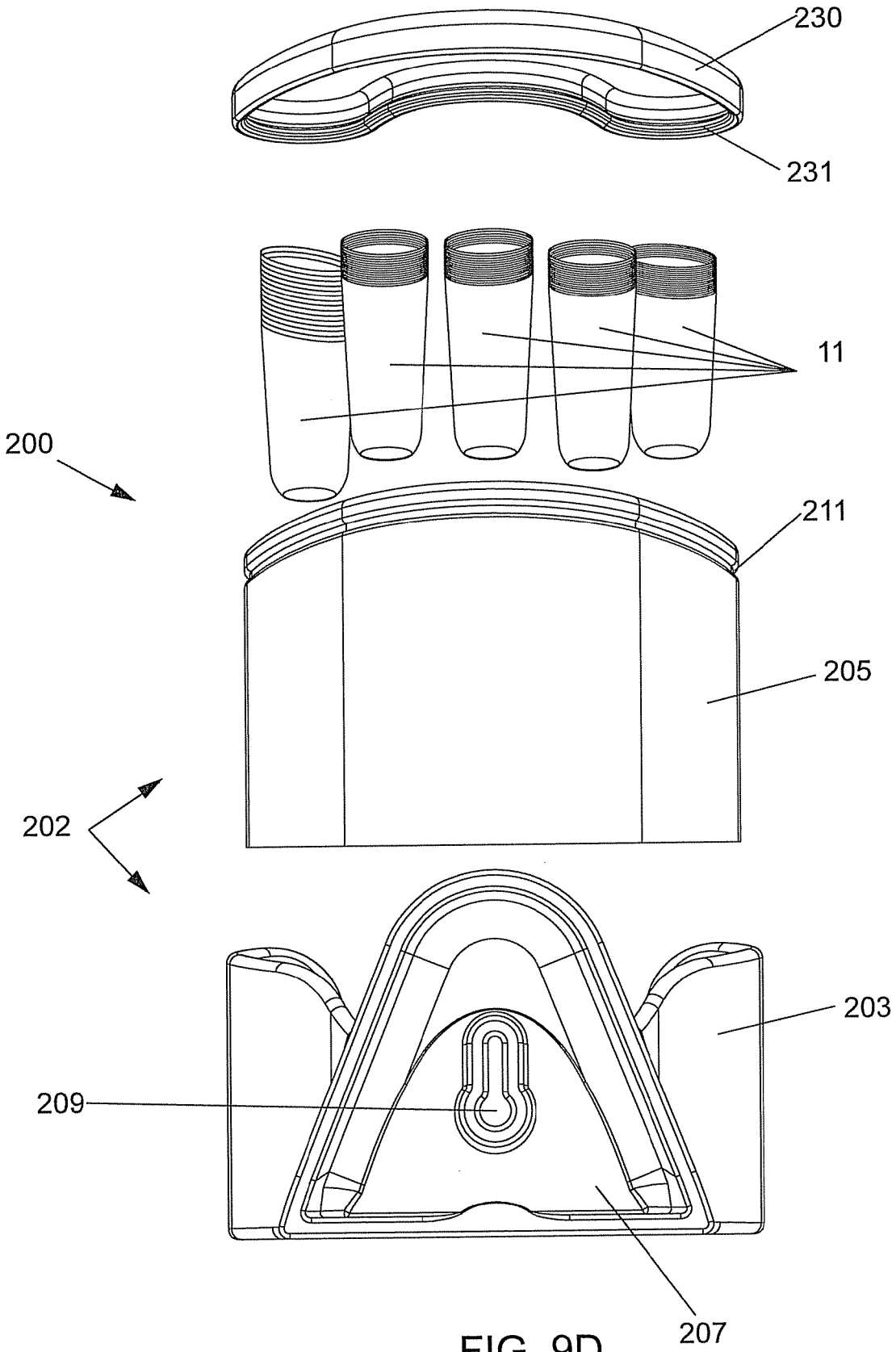
FIG. 9D is an exploded perspective view of the device of FIG. 9A.
Figure 9E:
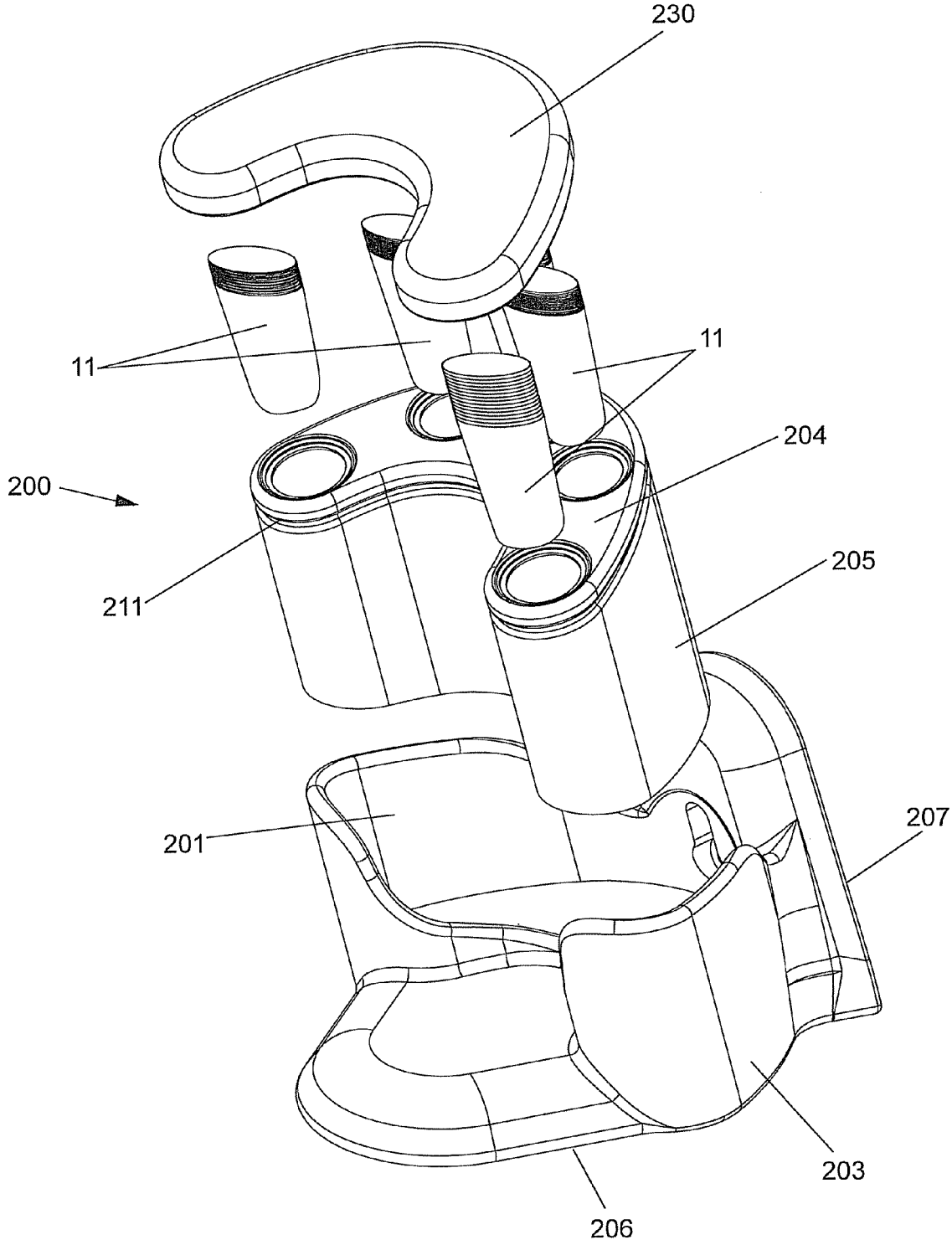
FIG. 9E is an upper front exploded perspective view of the device of FIG. 9A.
Figure 9F:
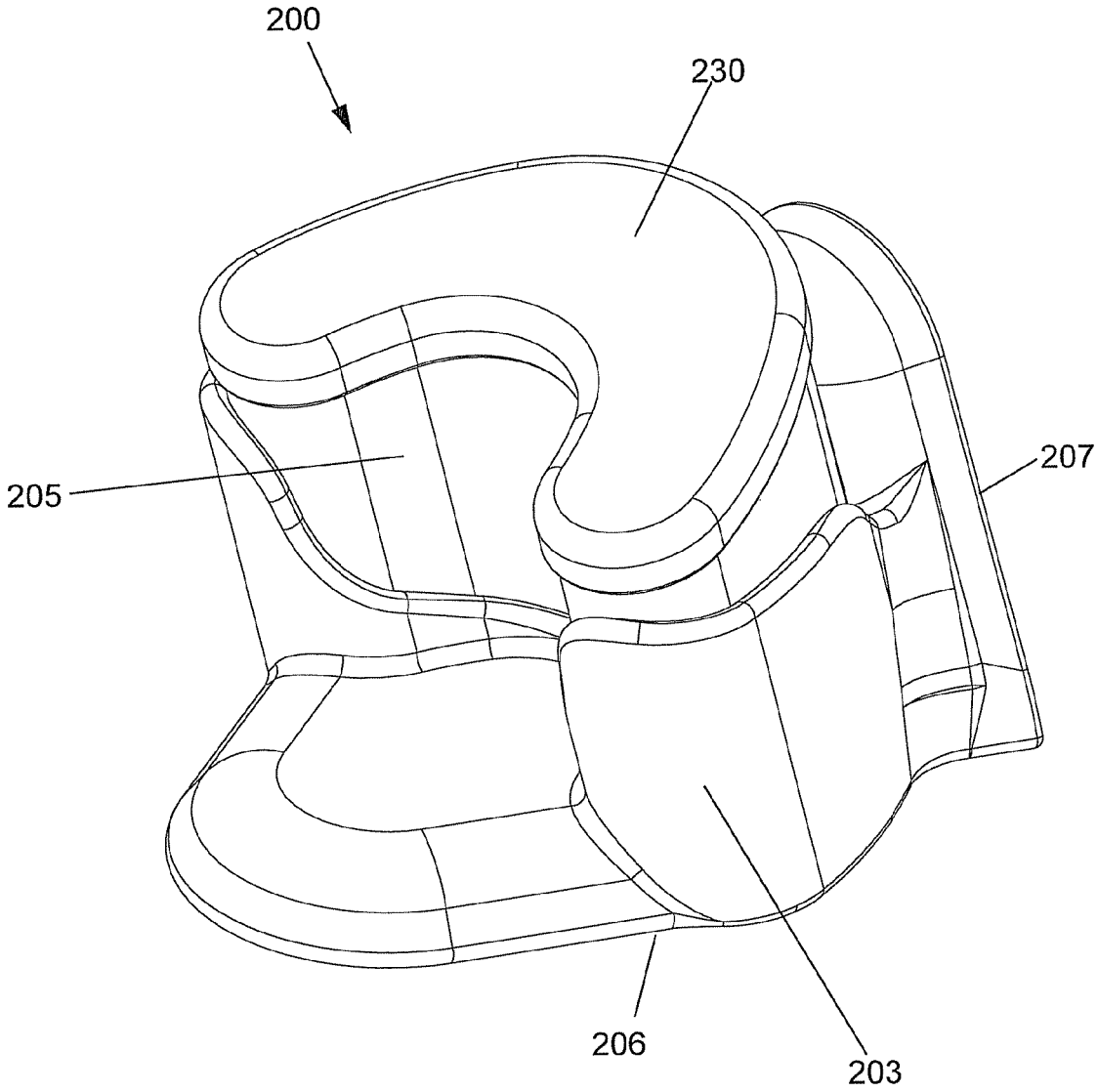
FIG. 9F is an upper front perspective view of the device of FIG. 9A, shown with the lid secured to the upper face of the device.
Figure 9G:
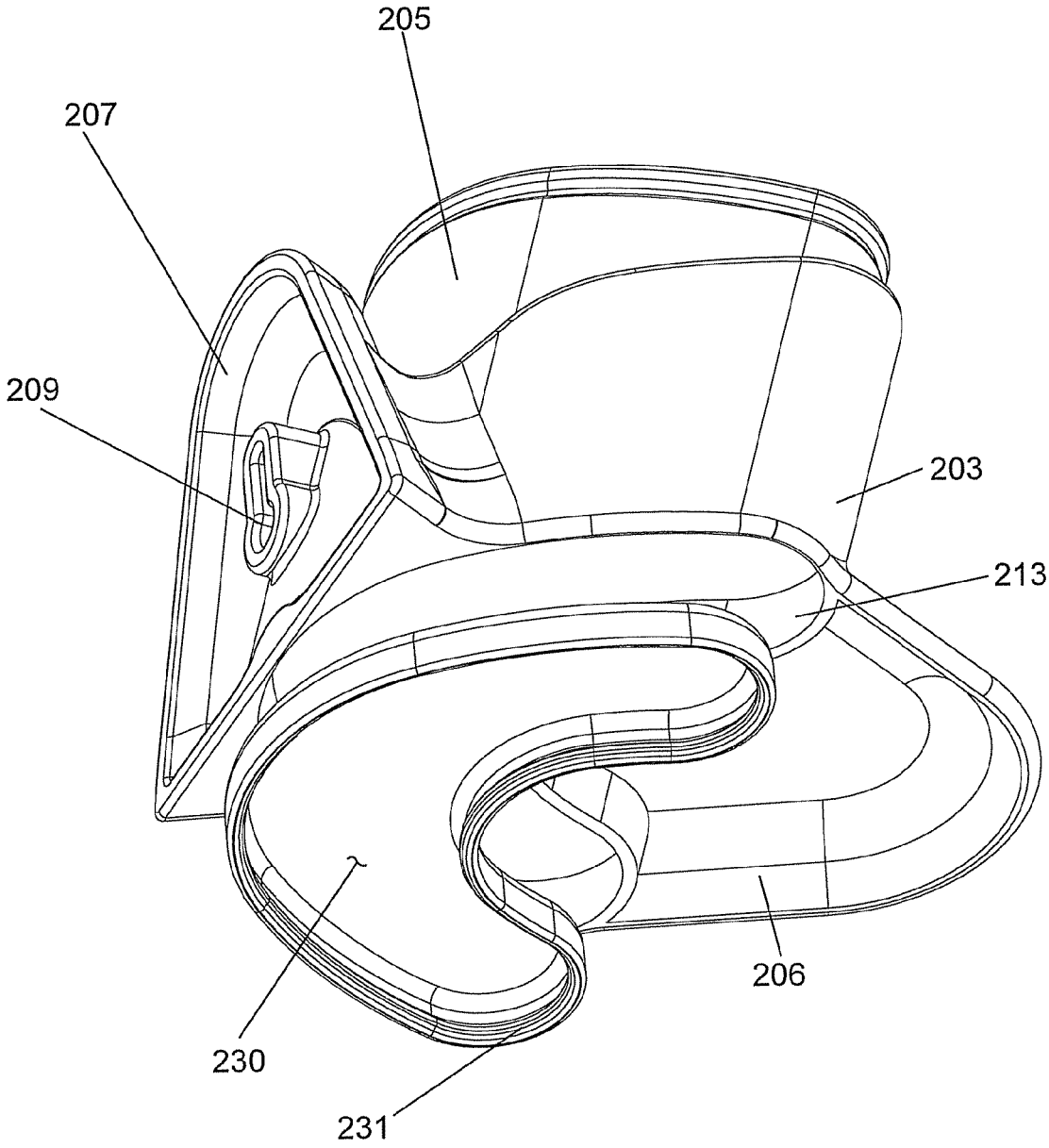
FIG. 9G is a lower rear partially exploded perspective view of the device of FIG. 9A.
Figure 9H:
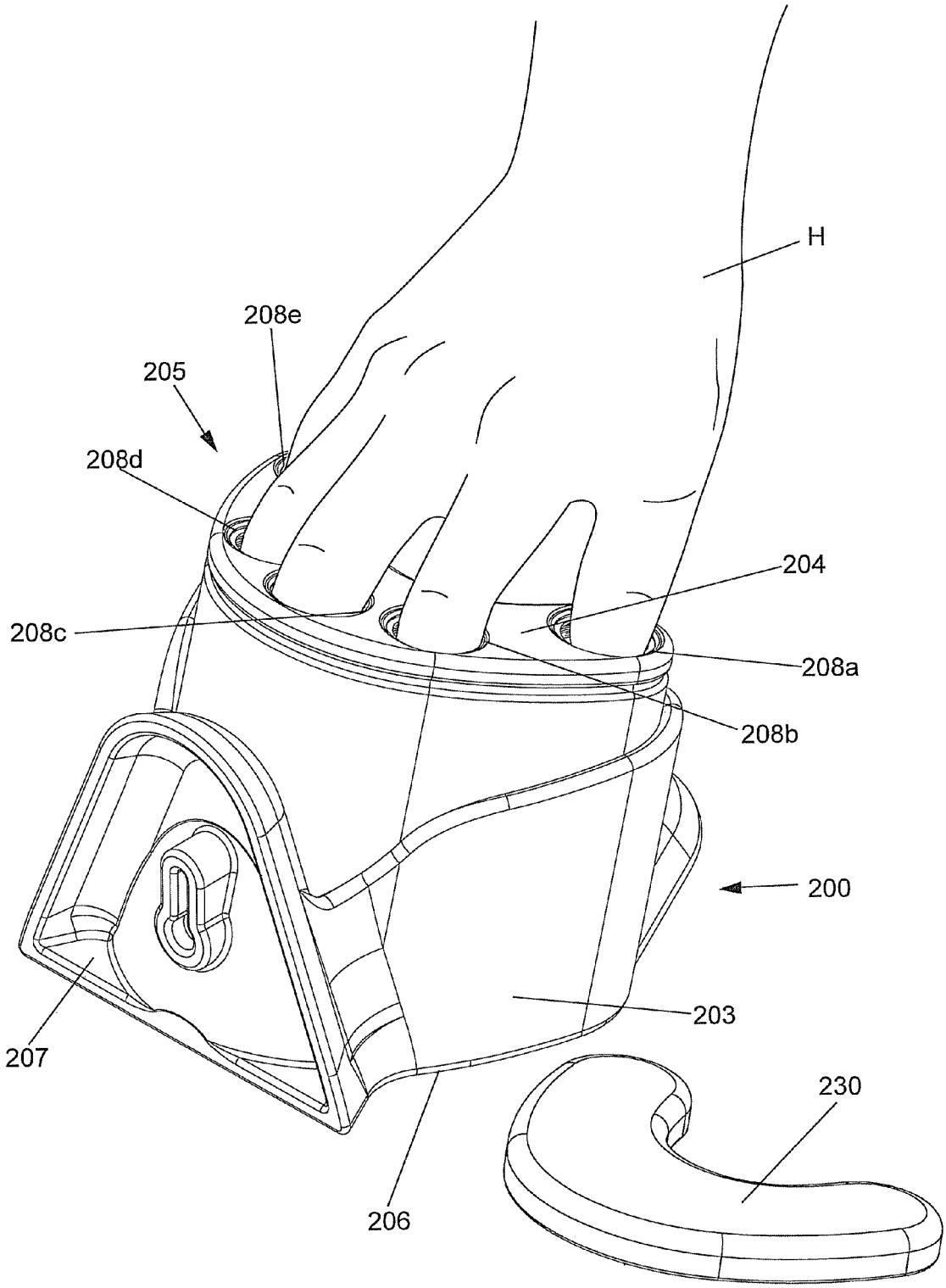
FIG. 9H is an upper perspective view of the device of FIG. 9A, shown with a user placing finger covers on his/her fingers.
Figure 9I:
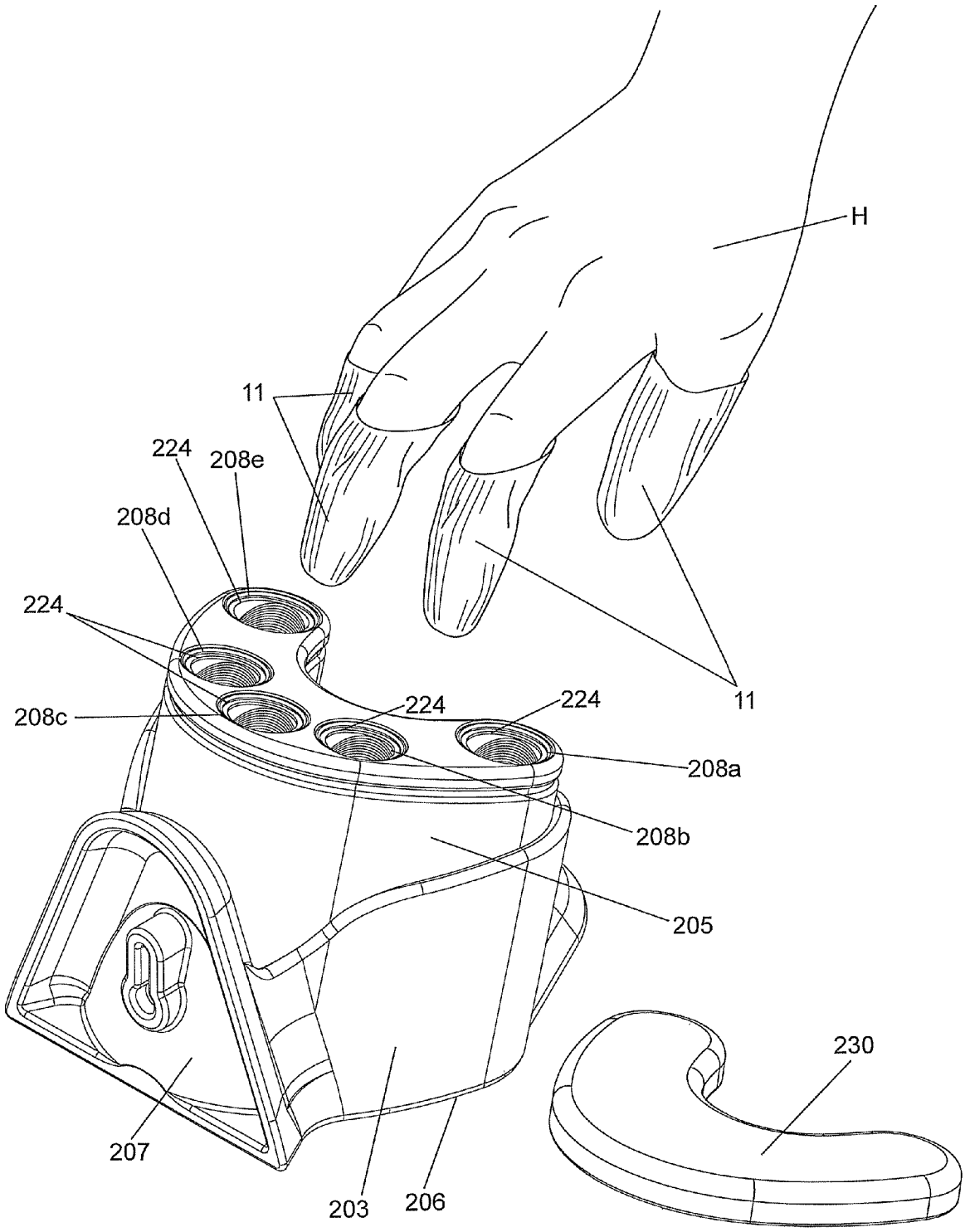
FIG. 9I is an upper perspective view of the device of FIG. 9A, shown with a user removing applied finger covers from the dispenser.

As shown, the device 200 only includes cavities 212*a-e* extending from the upper face 204 of the body 202, which allows a lower face or bottom surface 206 of the device to be more rigidly supported by or mounted to an external surface, such as, for example, a tabletop. Further, the body 202 may include a rear wall mount portion 207 configured to facilitate mounting the rear side of the device 200 to a vertical external surface, such as a wall or the front of a bar. The rear wall mount portion 207 can also be mounted horizontally, such as under a wall cabinet. As shown in FIG. 9B, the rear wall mount portion 207 may include a mounting hole 209 (e.g., a keyhole shaped mounting hole) to facilitate mounting with a nail, screw, or other fastener. The rear wall mount portion 207 may, but need not, be substantially perpendicular to the bottom surface 206, to present the upper face 204 of the body 202 in a consistent orientation, whether the rear wall mount surface is mounted to a vertical surface, or the bottom surface is mounted to or supported by a horizontal surface. As shown, the upper face 204 may be disposed at an angle $\alpha$ (e.g., a 15° angle) with respect to the bottom surface 206, for example, to facilitate insertion of a user's fingers into the openings 208*a-e* when the bottom surface 206 is supported on a horizontal surface in front of the user (see FIG. 9H), or when the rear wall mount portion 207 is secured to a vertical surface in front of the user.

While the body 202 of the device 200 may be provided as a unitary component, in the illustrated embodiment, the body 202 includes a housing 203 (on which the bottom surface 206 and rear wall mount portion 207 are disposed) and a removable cartridge 205 received (for example, in a tight, interference fit engagement) in a shell portion 201 (FIG. 9E) of the housing 203, the cartridge 205 defining the upper face 204, openings 208*a-e* and cavities 212*a-e* for retention of one or more finger covers. Removability of the finger cover retaining cartridge 205 from the mountable housing 203 may, for example, facilitate reloading of finger covers into the dispenser 200 without detaching the housing 203 from a mounted surface, cleaning of the cartridge 205, or replacement of the cartridge 205 with a new, fully loaded cartridge.

Figure 9J:
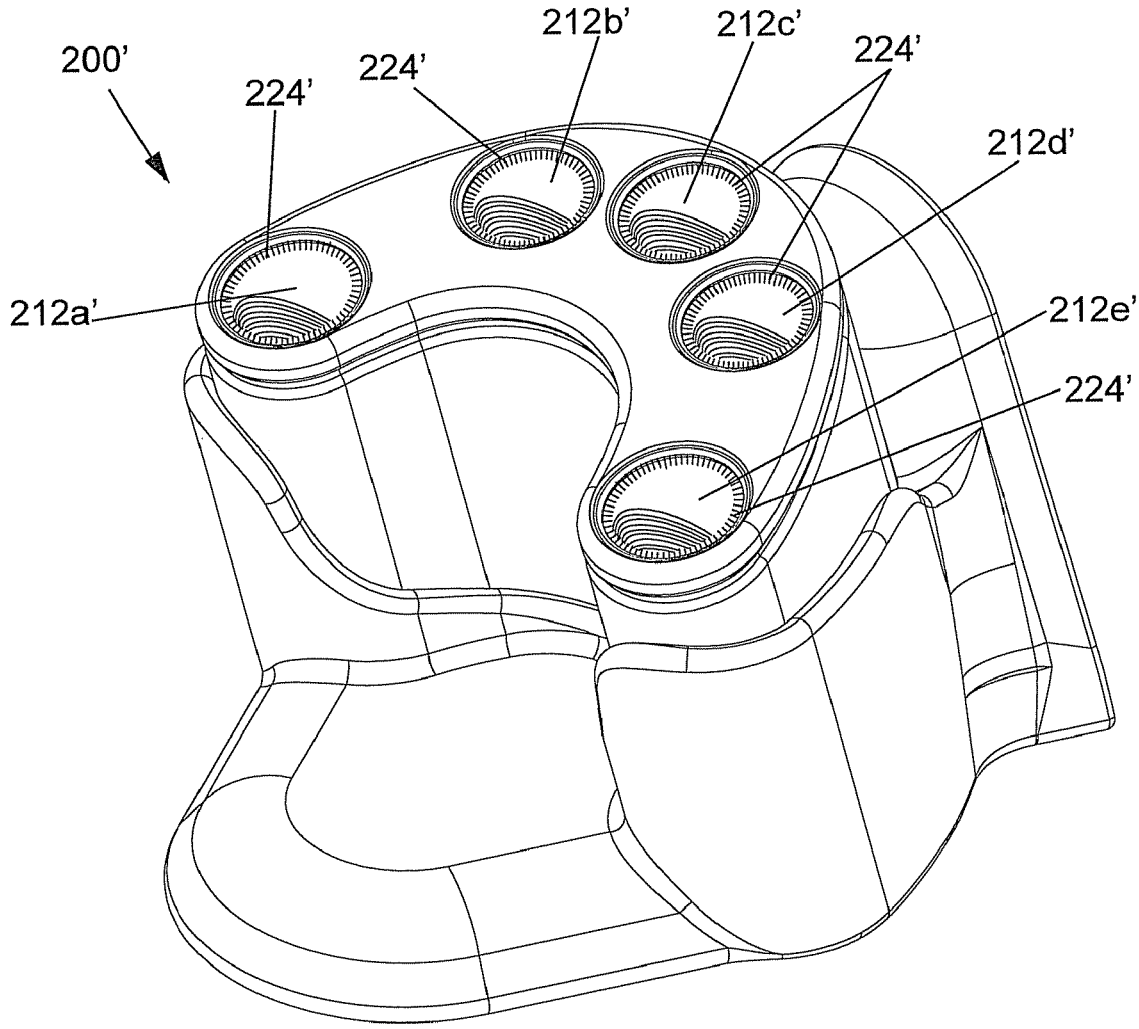
FIG. 9J is an upper front perspective view of another device for dispensing finger covers.
Figure 10B:
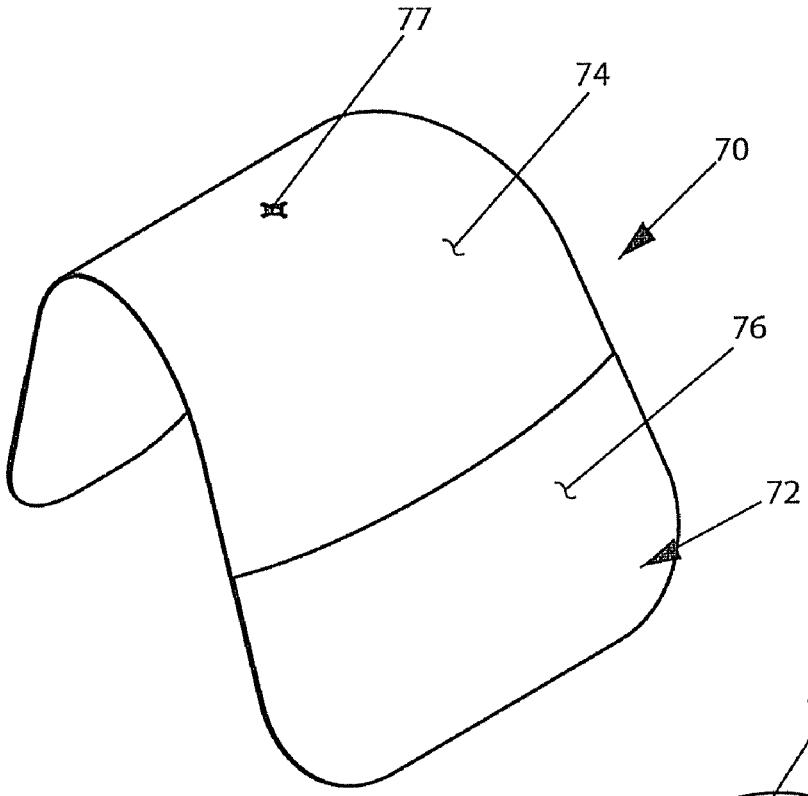
FIG. 10B is an upper perspective view of the mitt of FIG. 10A, shown contoured for placement on a user's hand.
Figure 10A:
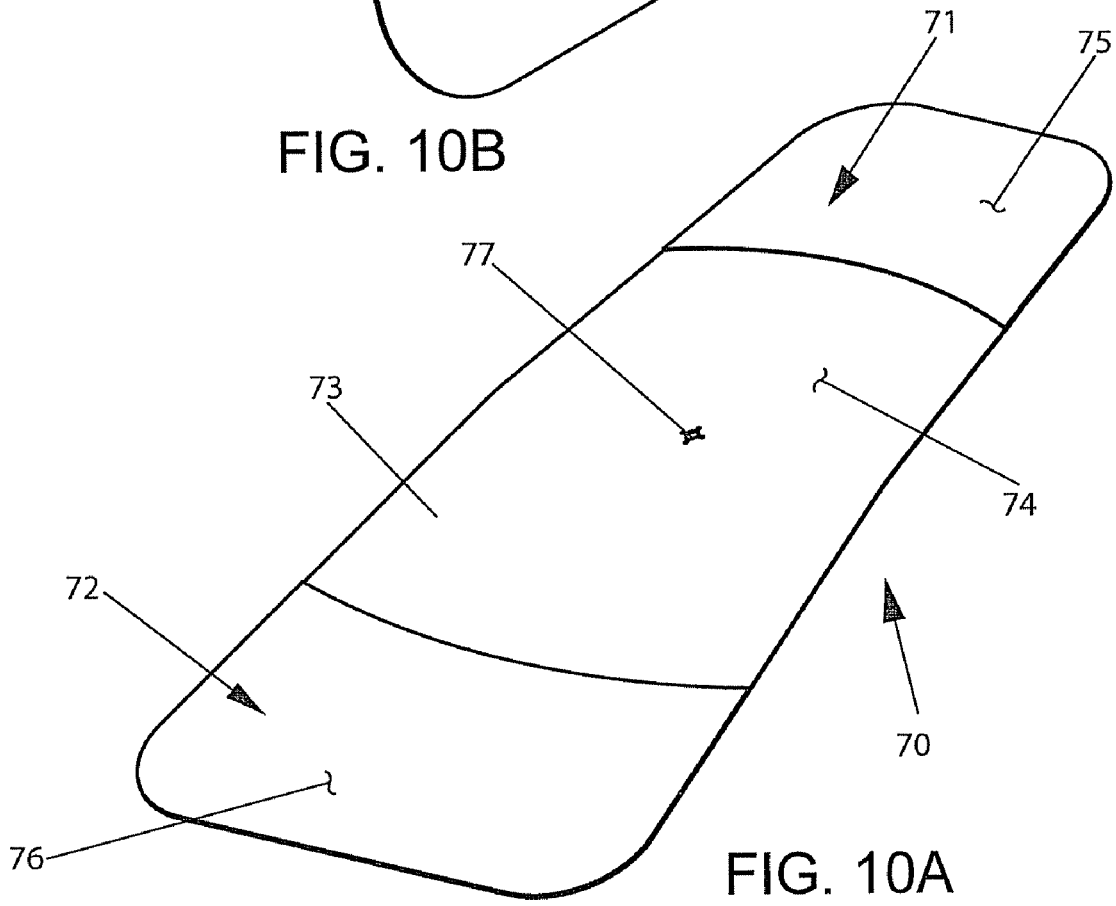
FIG. 10A is an upper perspective view of a mitt in a flattened condition.
Figure 10C:
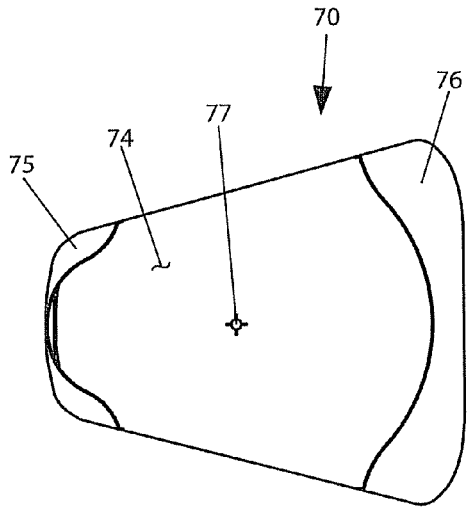
FIG. 10C is a top view of the mitt of FIG. 10A, shown with the finger cover envelopes in an open condition.
Figure 10D:
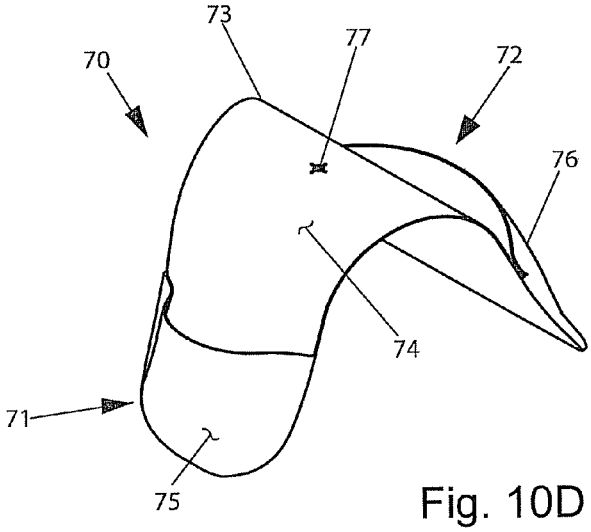
FIG. 10D is an upper perspective view of the mitt of FIG. 10A, shown with the finger cover envelopes in an open condition.
Figure 10E:
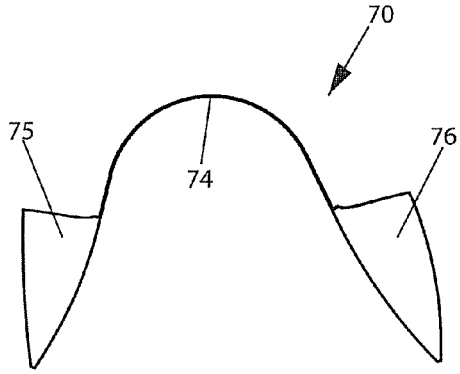
FIG. 10E is a side view of the mitt of FIG. 10A, shown with the finger cover envelopes in an open condition.

The illustrated device 200 may include flexible annular membranes or other such wipers 224 adapted to retain stacks of finger covers within the cavities 212*a-e* while allowing the inserted fingers and adhered finger covers 11 to be withdrawn from the cavity (see FIG. 91), which may be consistent with the membranes 124, 126 of the device 100 of FIGS. 7 and 8, and described in greater detail above. In another embodiment, as shown in FIG. 9J, cavities 212*a'-e'* of a dispenser 200' may be provided with wipers 224' formed from a plurality of flexible fibers, configured to permit installation of a stack of finger covers and withdrawal of a finger cover placed on a user's finger, while preventing the stored finger covers from inadvertently falling out of the dispenser 200'.

Other mechanisms or arrangements may additionally or alternatively be utilized to retain finger covers within a dispenser. For example, outer seals (e.g., lids or plugs) may be utilized to cover the openings in the device, thereby retaining the finger covers in the device until a user is ready to store additional finger covers in the dispenser or insert his or her fingers in the openings for application of the finger covers. The outer seals may be provided with a press fit or interference fit with the openings to secure the covers in the sealing condition. While the outer seals may be separate, loose components, the outer seals may alternatively be connected to the dispensing device to prevent the outer seals from being dropped or misplaced. For example, the outer seals may be hingedly connected to the end face of the dispensing device at one edge, with a gripping, sealing, or latching portion at an opposite edge. The outer seals may be provided in a flexible, convex material to facilitate user manipulation and maximize internal clearance for the stacked covers.

One such outer seal is utilized by the exemplary device 200 of FIGS. 9A-9G, which includes a lid 230 that may be selectively assembled over the openings 208*a-e* to retain the stacks of finger covers within the dispenser 200, or to prevent the cavities and contained finger covers from being exposed to dirt, moisture, and other contaminants when the dispenser 200 is not in use. As shown, the lid 230 may be provided with an internal lip 231 (FIG. 9C) that provides an interference or snap fit with a corresponding groove 211 in the cartridge 205. Additionally or alternatively, the lid 230 may be provided with one or more projections or plugs (not shown) positioned and sized to be tightly received in one or more of the openings 208*a-e* when the lid 230 is placed on the cartridge 205, for an interference fit or snap fit engagement. A complementary shaped recess 213 (FIG. 9G) may be provided in the bottom surface 206 of the body 202 to store the lid 230 when the lid is removed from the upper face 204. A tight interference fit may be provided between the lid 230 and the recess 213 for secure retention of the lid 230. The lid 320 can be removed from the recess 213 by grasping the interal lip 231 and pulling downward.

Still other types of finger covers may be constructed and utilized in accordance with the present application, and may include many of the features described above. In one embodiment, a single finger cover may be sized to accommodate more than one finger. For example, one finger cover may be provided to cover a thumb, with a larger finger cover provided to cover two or more of the index, middle, ring, and small fingers of a user (or just the index and middle fingers). In another embodiment, two or more finger covers may be connected to each other by a web or other such component.

FIGS. 10A-10E illustrate various views of an exemplary finger covering mitt 70 having first and second finger covers 71, 72 connected to each other by a flexible web portion 73. As shown, the exemplary mitt 70 includes a base sheet 74 and first and second covering sheets 75, 76 that are joined with the base sheet 74 (e.g., integrally joined or mechanically sealed) along first and second side edges and outermost edges to define envelope shaped first and second finger covers 71, 72 sized for receiving a user's fingers. The portion of the base sheet 74 extending between the unattached innermost edges of the first and second covering sheets 75, 76 forms the web portion 73. The covering sheets 75, 76 may be flexible enough to lay flat against the base sheet 74 when not in use, or to be spread to an open condition (i.e., spaced apart from the base sheet 74) for insertion of a user's fingers. While the base sheet 74 and covering sheets 75, 76 may be provided in many different shapes, in the illustrated embodiment, the first covering sheet 75 and corresponding end of the base sheet 74 are narrower, for example, to receive a user's thumb, and the second covering sheet 76 and corresponding end of the base sheet are wider, for example, to receive two or more of the user's other four fingers. The mitts 70 may be formed from any suitable flexible material, including, for example, materials that result in the mitt being at least partially moisture resistant or impermeable, stackable, sanitary, easily dispensable, and generally inexpensive. For example, the mitt 70 may be made of a laminated wax paper, vinyl, or parchment paper, and still allow for the finger to flex at the knuckles. As another example, the cover may include a flexible or stretchable material (e.g., latex or rubber) that conforms to the inserted finger to facilitate adhesion of the mitt 70 to the inserted fingers and/or palm. In still other embodiments, gene and virus impervious materials, bio-degradable materials, and/or optically clear materials (e.g., for inconspicuous usage) may additionally or alternatively be utilized.

As with the finger covers described above, two or more mitts 70 may be stacked for convenient storage or dispensing. While the finger covers 71, 72 may be received within finger covers of an adjacent mitt when stacked, in another embodiment, two or more mitts 70 are stacked in a substantially flat side-by-side condition, with a front surface of a first mitt 70 contacting a rear surface of a second mitt. To facilitate removal of a single mitt 70 from the stack, one or more reduced friction or non-stick surfaces, as described in greater detail above, may be provided on the front surface of the mitt 70 for ease of separation of the selected mitt 70 from the remainder of the stack. Further, to facilitate adhesion of the mitt 70 to a user's hand, one or more frictional or adhesive surfaces, as described in greater detail above, may be provided on a hand engaging portion of the rear surface of the mitt 70, such as, for example, along the web portion 73, or within the finger covers 71, 72. Reduced friction or non-stick surfaces may likewise be provided on mitt surfaces in contact with the frictional or adhesive surfaces, for example, on the front surface of the adjacent mitt 70, or on the inner surfaces of the covering sheets 75, 76. The front inner surface (or "fingerprint side") and the rear inner surface (or "fingernail side") of the finger covers 71, 72 may include adhesive and adhesive resistant surfaces consistent with any one or more of the above described embodiments of stacked tubular finger covers. This may, for example, allow the cover envelopes to open easily, while still providing adhesion to the palm and/or fingertips.

Further, to assist in retaining the mitts 70 in a uniform stack, the mitts may be provided with retaining apertures 77 that align when stacked for insertion of a retaining pin, clip, band, ring, or other such fastener, allowing the mitts to be held together without enclosing the stack (e.g., in a bag or box).

As with the individual finger covers 10, connected finger covers or mitts may also be kept in a sanitary condition and protected in a dispenser prior to use. In an inventive embodiment of a dispensing device applying at least some of the principles of the present application, a device is provided that stores stacks of connected finger covers or mitts in a manner that facilitates user insertion of two or more fingers into the finger covers. In one embodiment, the device includes a plurality of open-ended cavities in which finger covers are stored.

FIGS. 11A-11F illustrate an exemplary embodiment of a device for dispensing mitts having two or more connected finger covers, such as, for example, the mitts 70 described above. The device 300 comprises a body 302 having a plurality of cavities 308*a*, 308*b* adapted to house connected finger covers 71, 72 of a stack of mitts 70. The body 302 may be configured in a variety of ways. Any structure capable of housing two or more connected finger covers in an orientation in which the connected finger covers are received or placed onto fingers of a user when the user inserts the fingers into the structure may be used.

In the depicted embodiment, the body 302 has an upper face 304 and a lower face 306 opposite the upper face. The upper face 304 includes two openings 308*a*, 308*b*. The first opening 308*a* is oriented to receive the thumb of the user, and the second opening 308*b* is oriented to receive one or more of the other four fingers of the user, from either the right or left hand of the user. The spacing of the openings 308*a*, 308*b* on the first face 304 is configured similar to the spacing of the fingers on a person's hand if the person's hand is opened with the thumb spread apart from the other four fingers generally pointing in the same direction.

Figure 11A:
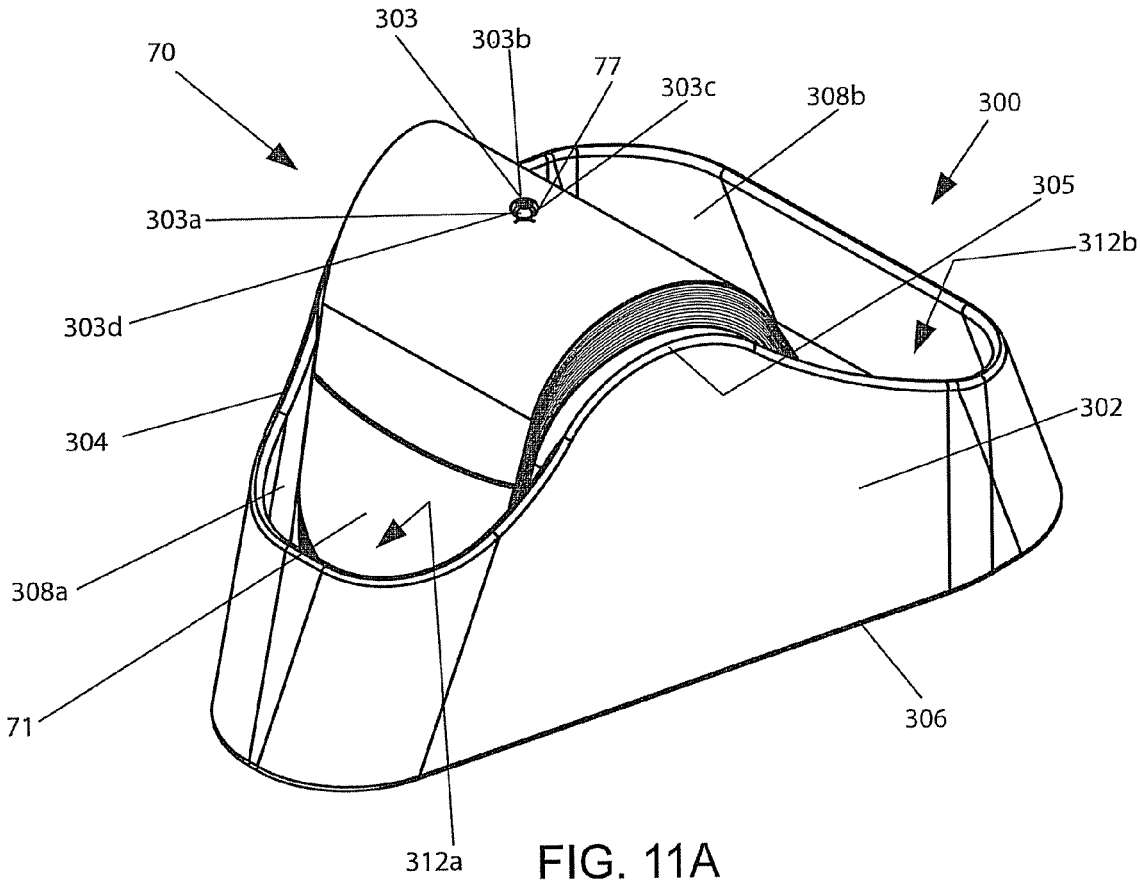
FIG. 11A is an upper side perspective view of a device for dispensing mitts.
Figure 11B:
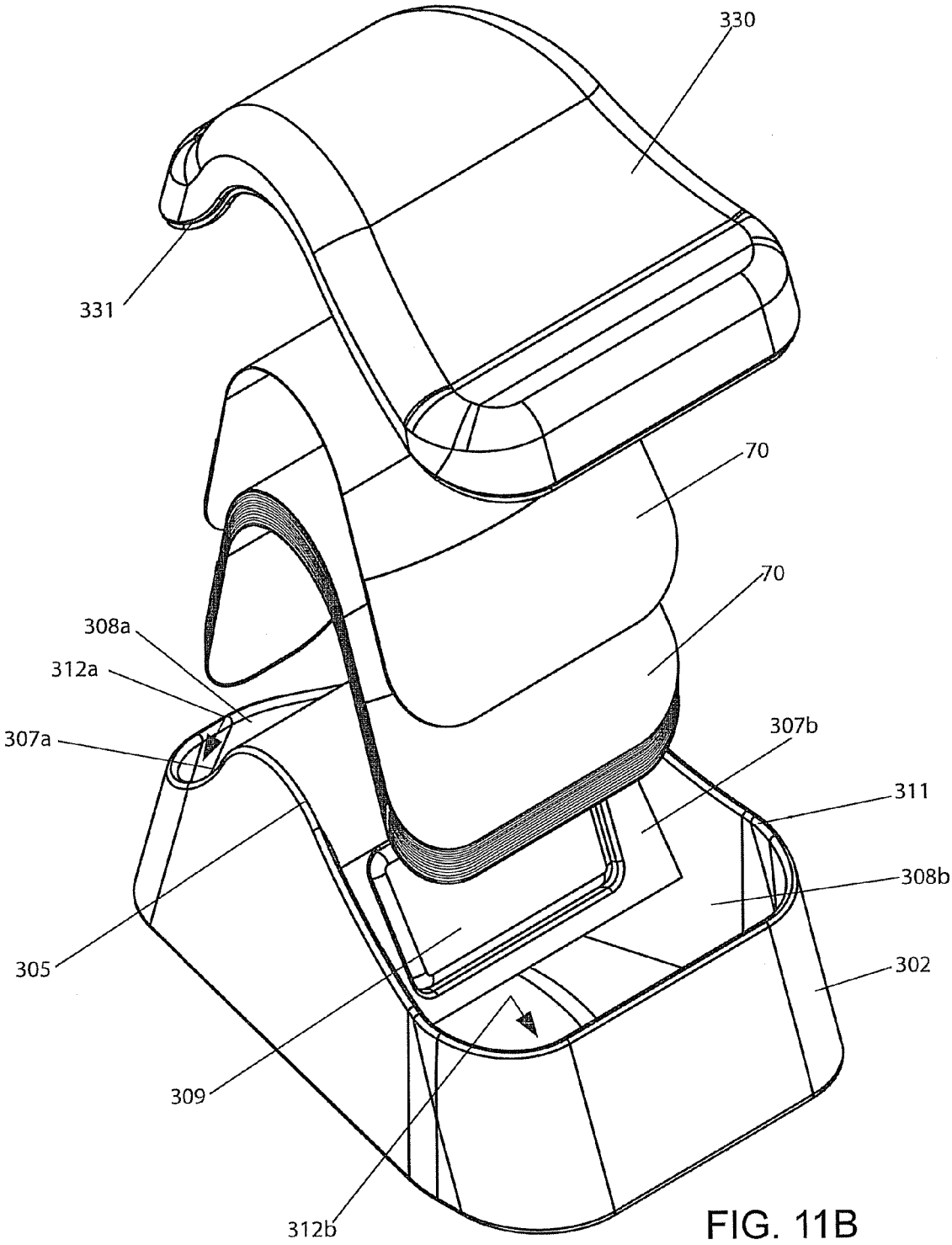
FIG. 11B is an upper exploded perspective view of the device of FIG. 11A.
Figure 11C:
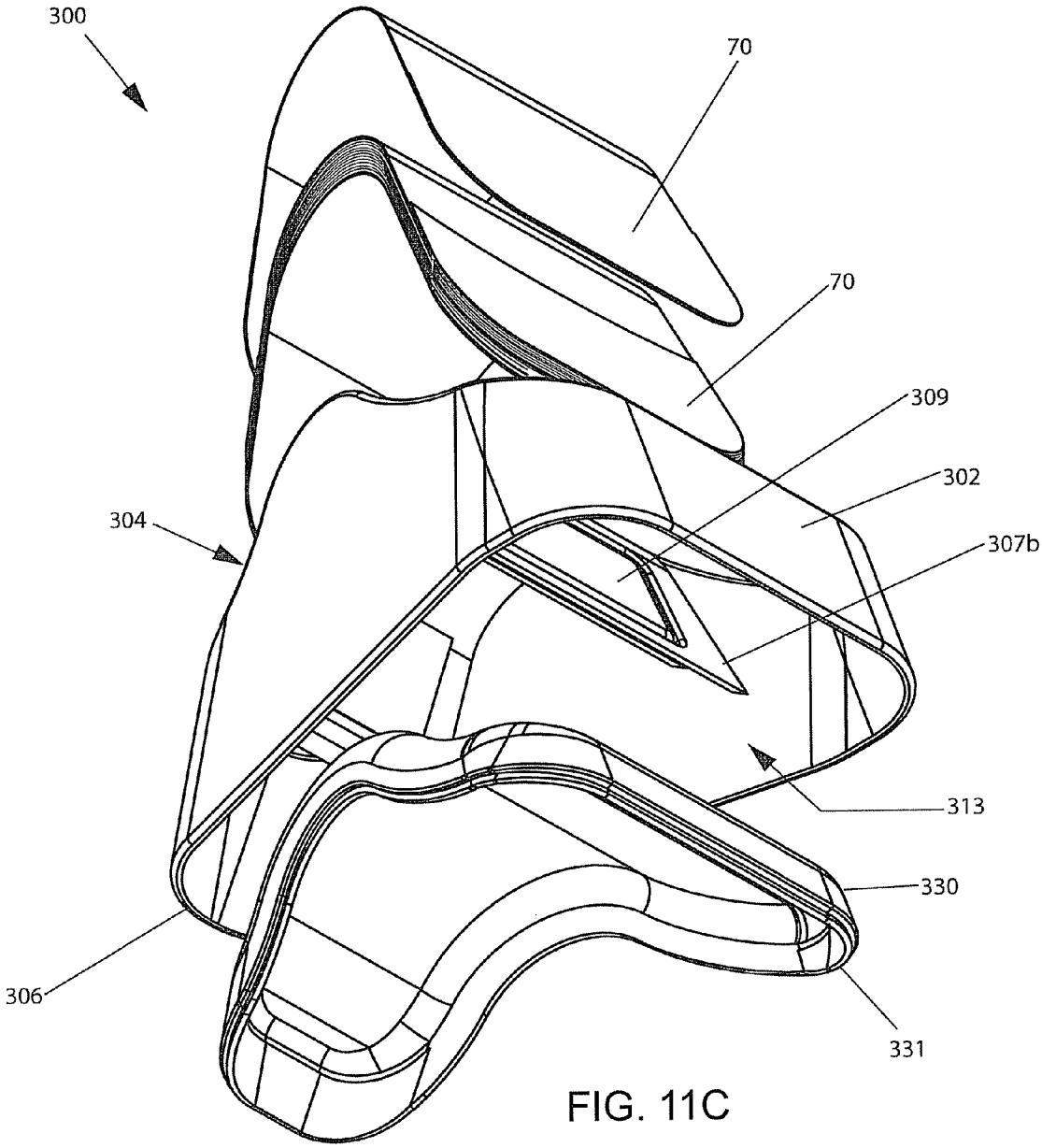
FIG. 11C is a lower exploded perspective view of the device of FIG. 11A.
Figure 11D:
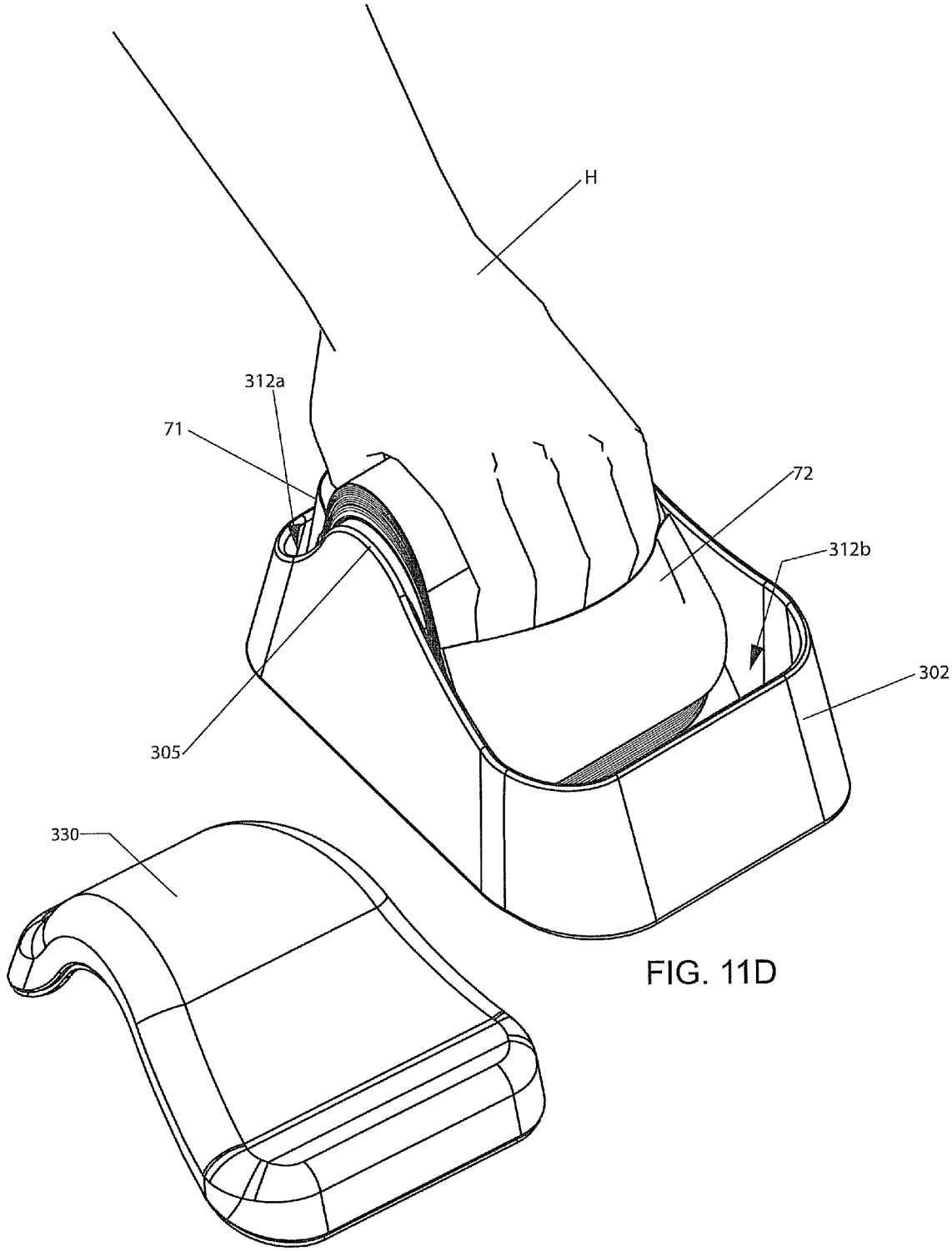
FIG. 11D is an upper perspective view of the device of FIG. 11A, shown with a user placing a mitt on his/her fingers.
Figure 11E:
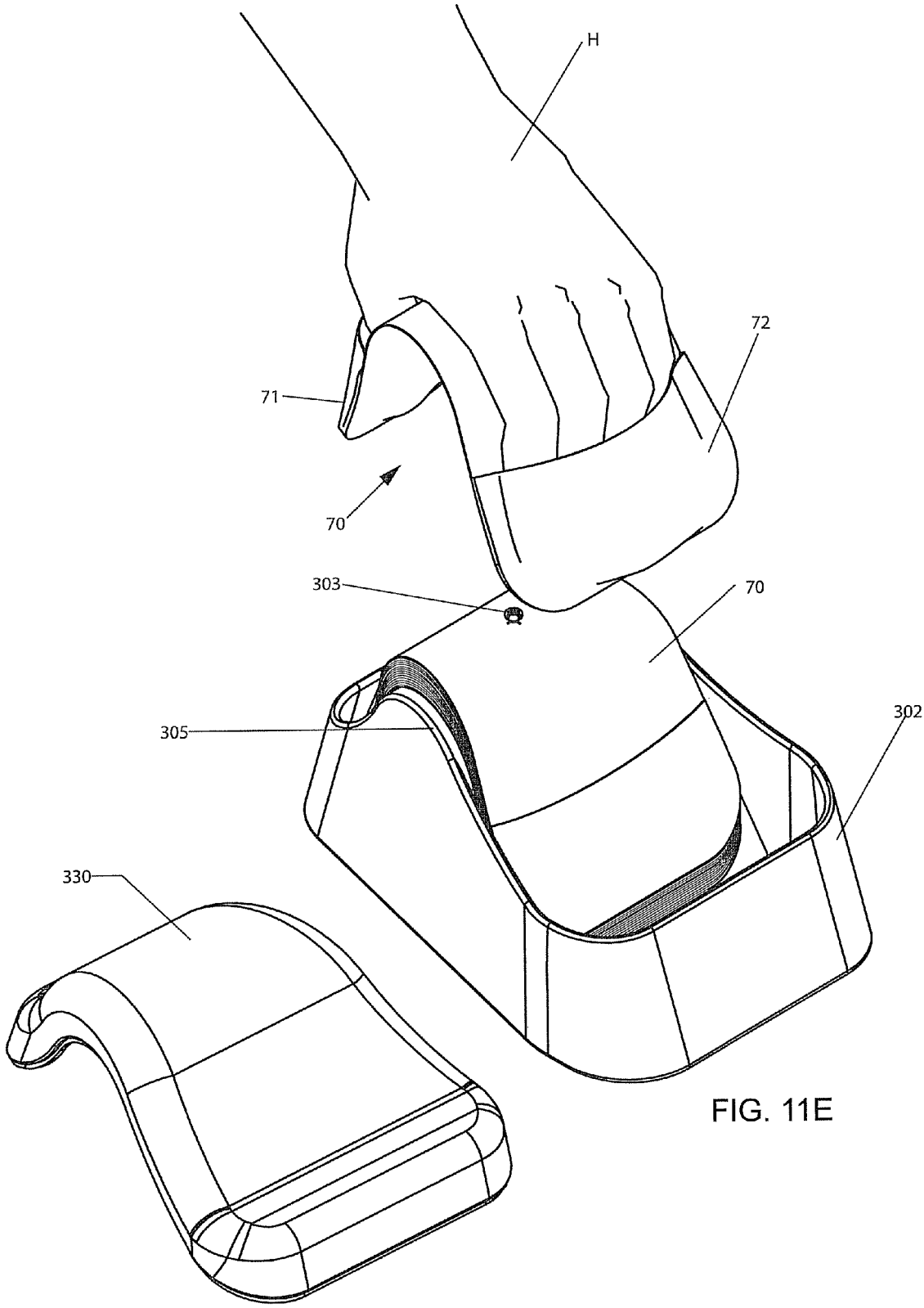
FIG. 11E is an upper perspective view of the device of FIG. 11A, shown with a user removing a mitt from the dispenser.
Figure 11F:
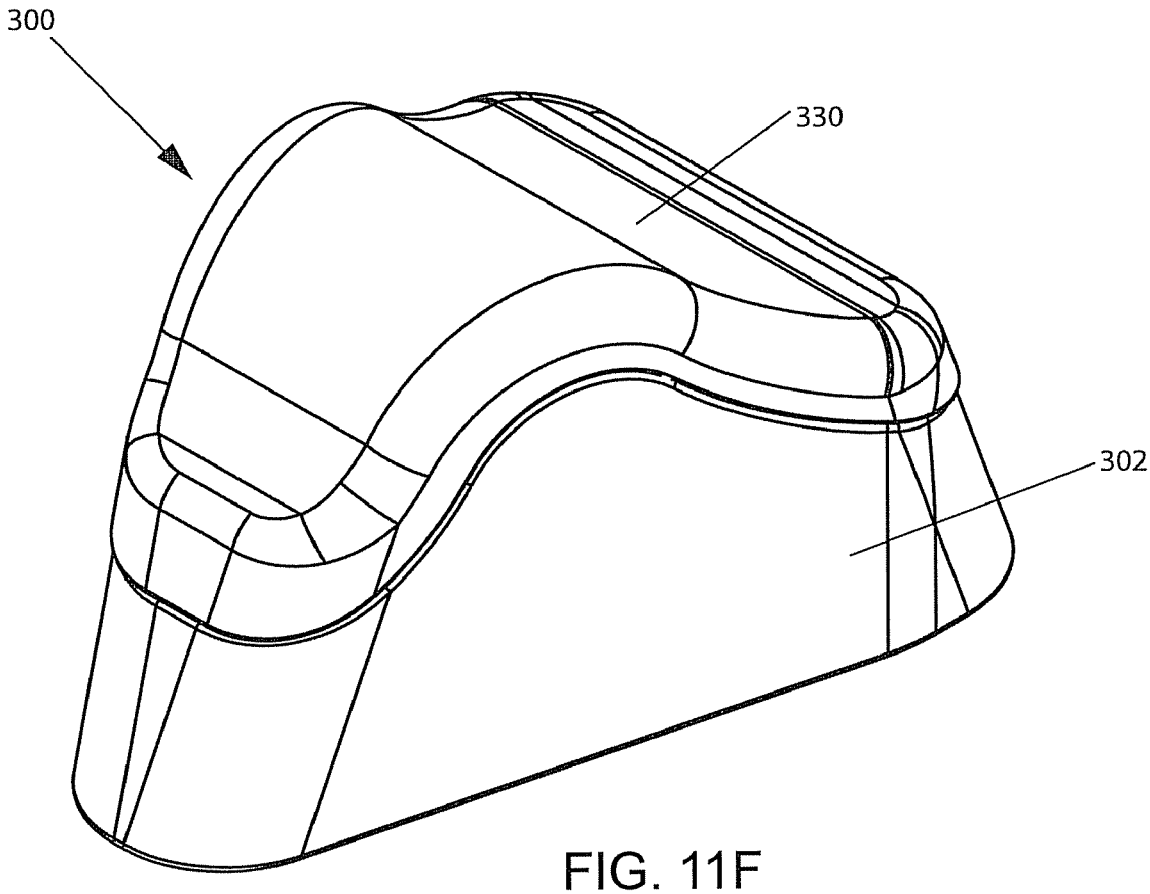
FIG. 11F is an upper perspective view of the device of FIG. 11A, shown with the lid secured to the upper face of the device.

As shown, the upper face 304 may further include a contoured saddle 305 disposed between the first and second openings 308*a*, 308*b*. The saddle 305 may be shaped to fit the palm of the user's hand, to facilitate a proper fit of the mitt 70 onto the user's hand H, as shown in FIG. 11D. First and second angled support walls 307*a*, 307*b* (FIG. 11B) extend from the saddle 305 into the cavities 312*a*, 312*b* to support a stack of mitts 70 in an orientation that facilitates placement of a mitt 70 on a user's fingers. Further, a retaining pin 303 extends from the saddle 305 for insertion through aligned retaining apertures 77 in the stacked mitts 70, thereby retaining the mitts 70 in an orderly stack (FIG. 11A). As shown, the retaining pin 303 may be radially compressible (for example, by forming the pin 303 from spaced apart flexible prongs 303*a-d*) to facilitate insertion and withdrawal from the aligned retaining apertures 77. To install a stack of flattened mitts 70 in the dispenser 300, the aligned retaining apertures 77 are placed over the retaining pin 303 with the finger cover envelopes 71, 72 facing upward. The first finger covers 71 are received in the first cavity 312*a*, and the second finger covers 72 are received in the second cavity 312*b*. The retaining apertures 77 may be slotted, for example, to facilitate easy withdrawal of the applied mitt 70 by lifting the user's hand H away from the dispenser 300 (see FIG. 11E).

Additionally, compressible pads 309 may be disposed on one or both of the angled support walls 307*a*, 307*b* to allow a user to squeeze or grip his or her fingers against the stack of mitts 70 while the fingers are being inserted into the cavities 312*a*, 312*b*, which may facilitate opening of the flattened finger covers 71, 72 for ease of insertion, and may assist in affixing the adhesive to the user's fingers. The pads may be constructed from any suitable compressible material, such as, for example, a foam rubber, memory foam, or other such material.

Figure 11G:
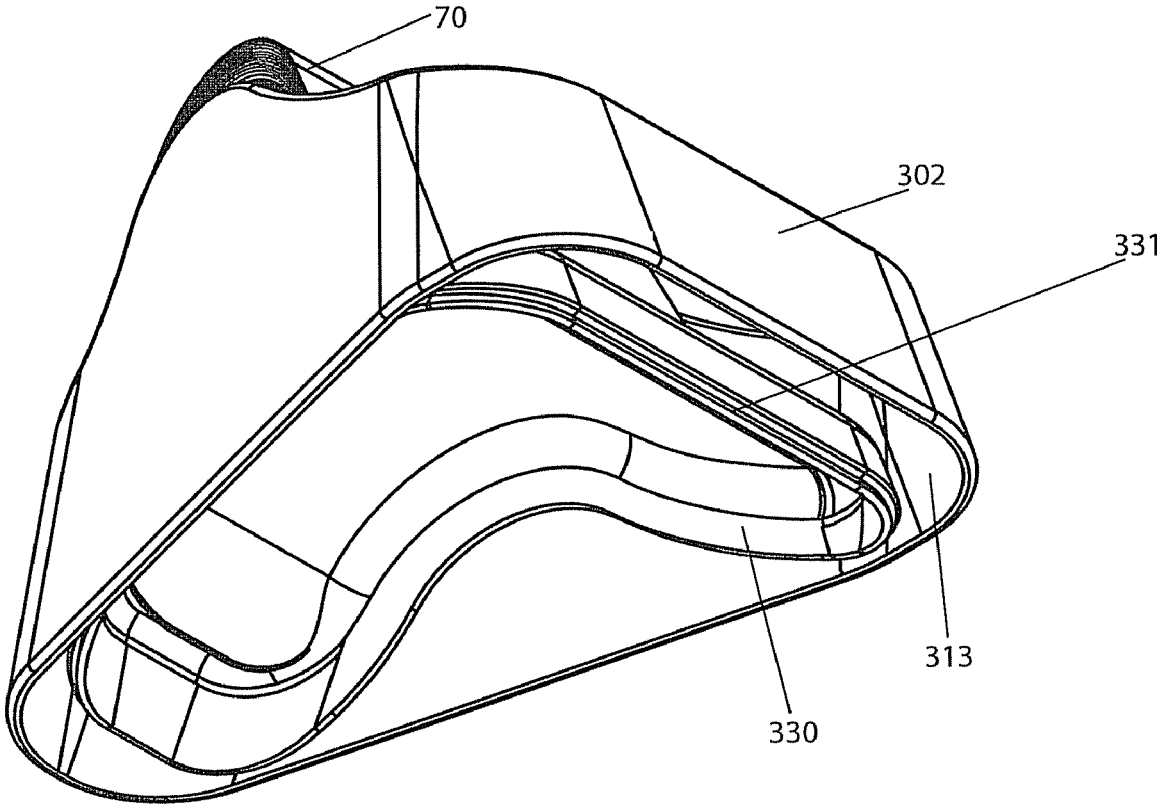
FIG. 11G is a lower perspective view of the device of FIG. 11A, shown with the lid stored in a recess of the body.

As with the individual finger cover dispensers described above, outer seals (e.g., lids or plugs) may be utilized to cover the openings in the device, thereby retaining the mitts in the device until a user is ready to store additional mitts in the dispenser or insert his or her fingers in the openings for application of the finger mitts. As shown in FIG. 11B, the illustrated device 300 includes a lid 330 that may be selectively assembled over the openings 308*a*, 308*b* and saddle 305 to retain the stacks of mitts 70 within the dispenser 300, or to prevent the cavities 312*a*, 312*b* and contained mitts 70 from being exposed to dirt, moisture, and other contaminants when the dispenser 300 is not in use. The lid 330 may be provided with recessed shoulder 331 that provides an interference or snap fit with a corresponding outer rim 311 on the body 302. The lid 330 may be removed from the rim 311 by grasping the sides of the lid, squeezing gently, and lifting up. A complementary shaped recess 313 may be provided in the lower face 306 of the body 302 to store the lid 330 when the lid is removed from the upper face 304 (FIG. 11C). A tight interference fit may be provided between the lid 330 and the recess 313 for secure retention of the lid 330 (FIG. 11G). The lid 330 may be removed from the recess 313 (for example, for closure of the dispenser 300) by pulling on the recessed shoulder 331 in the spaces on either end between the body 302 and the lid 330, or by pushing through openings 312*a* and/or 312*b* (FIG. 11B) to dislodge the lid 330. Additionally or alternatively, a pull tab (not shown) may be provided on the underside of the lid 330 to facilitate withdrawal.

The invention has been illustrated by the above description of embodiments, and while the embodiments have been described in some detail, it is not the intent of the applicant to restrict or in any way limit the scope of the invention to such detail. Additional advantages and modifications will readily appear to those skilled in the art. Therefore, the invention in its broader aspects is not limited to the specific details, representative apparatus and methods, and illustrative examples shown and described. Accordingly, departures may be made from such details without departing from the spirit or scope of the applicant's general or inventive concept.

What is claimed is:

1. A mitt dispensing device comprising:

a body having an upper surface and first and second openings disposed in the upper surface, the first opening being sized to receive a thumb inserted therethrough, the second opening being sized to receive one or more opposed fingers inserted therethrough, a raised saddle portion spanning the first and second openings;

first and second cavities disposed in the body extending inward from the corresponding first and second openings, the first and second cavities being sized to retain a plurality of stacked finger covering envelopes of a plurality of stacked mitts, the first and second cavities being at least partially defined by spaced apart first and second angled support walls extending inward from the saddle portion; and at least one flexible retaining feature extending from the upper surface of the body to releasably retain the plurality of stacked mitts within the first and second cavities, such that when fingers of a user's hand are inserted into the first and second cavities and received within the finger covering envelopes of an outermost mitt retained in the first and second cavities, the flexible retaining feature permits release of the outermost mitt when the fingers are withdrawn from the first and second cavities.

2. The device of claim 1, wherein the at least one flexible retaining feature comprises a radially compressible retainer pin extending from the saddle portion.

3. The device of claim 1, further comprising a lid adapted to be secured over the first and second openings.

4. The device of claim 1, wherein the first and second angled support walls comprise compressible surfaces configured to facilitate gripping engagement of the outermost mitt by fingers inserted in the finger covering envelopes of the outermost mitt.

5. The device of claim 4, wherein the compressible surfaces of the first and second angled support walls comprise compressible foam pads.

6. The device of claim 1, wherein the saddle portion extends outward of the first and second openings.

7. A mitt dispensing system comprising a mitt dispensing device and a plurality of finger covering mitts including first and second finger covering portions connected by a flexible web portion, the mitt dispensing device comprising:

a body having an upper surface and first and second openings disposed in the upper surface, the first opening being sized to receive a thumb inserted therethrough, the second opening being sized to receive one or more opposed fingers inserted therethrough, and a raised saddle portion spanning the first and second openings;

first and second cavities disposed in the body extending inward from the corresponding first and second openings, the first and second cavities retaining the corresponding first and second finger covering portions of the plurality of finger covering mitts in a stacked arrangement, with the raised saddle portion supporting the flexible web portions of the plurality of finger covering mitts, the first and second cavities being at least partially defined by spaced apart first and second angled support walls extending inward from the saddle portion, wherein the first and second angled support walls comprise compressible surfaces configured to facilitate gripping engagement of an outermost mitt by fingers inserted in the first and second finger covering portions of the outermost mitt; and at least one flexible retaining feature extending from the upper surface of the body to releasably retain the plurality of stacked mitts within the first and second cavities, such that when fingers of a user's hand are inserted into the first and second cavities and received within the finger covering portions of the outermost mitt retained in the first and second cavities, the flexible retaining feature permits release of the outermost mitt when the fingers are withdrawn from the first and second cavities.

8. The system of claim 7, wherein the at least one flexible retaining feature comprises a retaining pin extending from the saddle portion, the retaining pin being inserted through aligned retaining apertures in the web portions of the finger covering mitts.

9. The system of claim 7, wherein the first finger covering portion of a first fmger covering mitt of the plurality of finger covering mitts is received in the first finger covering portion of an adjacent second finger covering mitt of the plurality of finger covering mitts, and the second finger covering portion of the first finger covering mitt is received in the second finger covering portion of the second finger covering mitt.

10. The system of claim 7, wherein the plurality of finger covering mitts are stacked with the first and second finger covering portions in a flattened side-by-side relationship.

11. The system of claim 7, wherein the first and second finger covering portions of each of the plurality of finger covering mitts are formed from a covering sheet joined along three edges with a base sheet to form an envelope, wherein a portion of the base sheet spans between corresponding ones of the first and second finger covering portions to form the web portion.

12. A mitt dispensing system comprising a mitt dispensing device and a plurality of finger covering mitts including first and second finger covering portions connected by a flexible web portion, the mitt dispensing device comprising:

a body having an upper surface and an opening disposed in the upper surface;

first and second angled support walls extending inward from the opening to divide an interior of the body into first and second cavities, the first and second cavities retaining the first and second finger covering portions of the plurality of finger covering mitts in a stacked arrangement, with the flexible web portions of the plurality of finger covering mitts being supported in a raised position between spaced apart upper ends of the first and second angled support walls; and at least one flexible retaining feature extending from the upper surface of the body to releasably retain the plurality of stacked mitts within the first and second cavities, such that when fingers of a user's hand are inserted into the first and second cavities and received within the first and second finger covering portions of an outermost mitt retained in the first and second cavities, the flexible retaining feature permits release of the outermost mitt when the fingers are withdrawn from the first and second cavities.

13. The system of claim 12, further comprising a saddle portion extending between the spaced apart upper ends of the first and second angled support walls.

14. The system of claim 13, wherein the saddle portion is defined by the upper surface of the body.

15. The system of claim 13, wherein the saddle portion extends outward of the opening to divide the opening into first and second opening portions, the first opening portion being sized to receive a thumb inserted therethrough, the second opening portion being sized to receive one or more opposed fingers inserted therethrough.

16. The system of claim 13, wherein the saddle portion and the first and second angled support walls together form a continuous mitt supporting surface.

17. The system of claim 12, wherein the flexible retaining feature comprises a radially compressible retainer pin extending from the saddle portion.

18. The system of claim 12, wherein the first and second angled support walls comprise compressible surfaces configured to facilitate gripping engagement of the outermost mitt by fingers inserted in the finger covering portions of the outermost mitt.

19. The system of claim 18, wherein the compressible surfaces of the first and second angled support walls comprise compressible foam pads.

20. The system of claim 12, further comprising a lid adapted to be secured over the opening.

* * * * *